US011498740B2

(12) United States Patent
Abe

(10) Patent No.: US 11,498,740 B2
(45) Date of Patent: Nov. 15, 2022

(54) PACKAGING MATERIAL, PACKAGING BAG, AND PACKAGING METHOD

(71) Applicant: NICHIWA CO., LTD., Numazu (JP)

(72) Inventor: Tomematsu Abe, Numazu (JP)

(73) Assignee: NICHIWA CO., LTD., Numazu (JP)

( * ) Notice: Subject to any disclaimer, the term of this patent is extended or adjusted under 35 U.S.C. 154(b) by 335 days.

(21) Appl. No.: 16/619,766

(22) PCT Filed: Jun. 6, 2018

(86) PCT No.: PCT/JP2018/021644
§ 371 (c)(1),
(2) Date: Dec. 5, 2019

(87) PCT Pub. No.: WO2018/225758
PCT Pub. Date: Dec. 13, 2018

(65) Prior Publication Data

US 2020/0140178 A1 May 7, 2020

(30) Foreign Application Priority Data

Jun. 6, 2017 (JP) ..... JP2017-111585

(51) Int. Cl.
*B65D 81/05* (2006.01)
*B65B 5/02* (2006.01)
*B65B 31/04* (2006.01)

(52) U.S. Cl.
CPC ..... *B65D 81/052* (2013.01); *B65B 5/022* (2013.01); *B65B 31/04* (2013.01)

(58) Field of Classification Search
CPC ..... B65D 81/052; B65D 81/05
(Continued)

(56) References Cited

U.S. PATENT DOCUMENTS 7,681,379 B2 3/2010 Nishi et al.
9,700,161 B2 7/2017 Yoshifusa et al.
(Continued)

FOREIGN PATENT DOCUMENTS

JP 2003-118772 A 4/2003
JP 2003-137352 A 5/2003
(Continued)

OTHER PUBLICATIONS

PCT/ISA/210, "International Search Report for International Application No. PCT/JP2018/021644," dated Aug. 28, 2018.

*Primary Examiner* — Steven A. Reynolds
(74) *Attorney, Agent, or Firm* — Manabu Kanesaka

(57) ABSTRACT

The packaging material includes a packaging material body formed into a sheet shape as a whole by welding two film sheets having an upper sheet and a lower sheet together at appropriate points; an air introduction path having the packaging material body, one side thereof serving as an air introduction port and the other side sealed; a plurality of air bags having the packaging material body while being in communication with the air introduction path, and extending in a direction orthogonal to the air introduction path; and check valves provided to respective air inlets of the plurality of air bags and preventing escaping of air having been introduced through the air introduction port and introduced into the air bags through the air inlets. The packaging material body is bent and welded at appropriate points, whereby a packaging bag for storing a packaged object is provided.

7 Claims, 25 Drawing Sheets

(58) Field of Classification Search
USPC ..... 206/522, 521; 383/3
See application file for complete search history.

(56) References Cited

U.S. PATENT DOCUMENTS

| | | | | |
|---|---|---|---|---|
| 2002/0081041 | A1* | 6/2002 | Malone | B29C 66/81427 428/68 |
| 2007/0051656 | A1* | 3/2007 | Hsin | B65D 81/052 383/3 |
| 2007/0175522 | A1 | 8/2007 | Chen et al. | |
| 2009/0050509 | A1* | 2/2009 | Liao | B65D 81/052 206/522 |
| 2009/0173649 | A1 | 7/2009 | Liao | |
| 2017/0247164 | A1* | 8/2017 | Zhang | B65D 81/052 |
| 2019/0062027 | A1* | 2/2019 | Kim | B65D 81/022 |

FOREIGN PATENT DOCUMENTS

| | | | |
|---|---|---|---|
| JP | 2004-338785 | A | 12/2004 |
| JP | 2006-188287 | A | 7/2006 |
| JP | 2009-137587 | A | 6/2009 |
| JP | 2009-161245 | A | 7/2009 |
| JP | 2011-140342 | A | 7/2011 |
| JP | 2014-069865 | A | 4/2014 |
| JP | 2014-101145 | A | 6/2014 |
| JP | 2016-050028 | A | 4/2016 |
| JP | 2017-137112 | A | 8/2017 |
| WO | 2015/192708 | A1 | 12/2015 |

* cited by examiner

PACKAGING MATERIAL, PACKAGING BAG, AND PACKAGING METHOD

RELATED APPLICATIONS

The present application is National Phase of International Application No. PCT/JP2018/021644 filed Jun. 6, 2018, and claim priority from Japanese Application No. 2017-111585, filed Jun. 6, 2017, the disclosure of which is hereby incorporated by reference herein in its entirety.

TECHNICAL FIELD

The present invention relates to a packaging material, packaging bag, packaging article and packaging method, used for accommodating, as a packaged object, for example, foods and beverages such as eggs, tofu, vegetables, fruits or milk, which require a heat insulation material, or daily commodities such as garment or furniture, or fragile articles, such as electronic parts, precision instruments or semiconductors, and more specifically, the present invention relates to those which, by adding a buffer function to the packaging material itself, facilitate complicated packaging and unpackaging of the packaged object, and also simplify discarding after using thereof.

BACKGROUND ART

In general, for the purpose of accommodating, as a packaged object, for example, foods and beverages such as eggs, tofu, vegetables, fruits or milk, which require a heat insulation material, or daily commodities such as garment or furniture, or fragile articles, such as electronic parts, precision instruments or semiconductors, a cardboard box as shown in Patent Document 1 as an example, is used as the packaging material.

Moreover, for the purpose of preventing from unintended movement of the packaged object, or preventing from vibration or impact caused by the outer environment, a buffer material made of foamed plastic as shown in Patent Document 2 as an example, is used.

REFERENCE DOCUMENTS OF CONVENTIONAL ART

Patent Document(S)

Patent Document 1: Official Gazette, JP 2014-69865 A.
Patent Document 2: Official Gazette, JP 2014-101145 A.

SUMMARY OF THE INVENTION

Problems to be Solved by Invention

However, the above structures of the conventional arts have the following problems:

First, where the cardboard box is used as the packaging material, during packaging and unpackaging of the packaged object, it is necessary to assemble and disassemble of the cardboard box, which requires troublesome complicated, physically heavy labor.

Moreover, since the cardboard box is bulky, a wide space is required for the storage, and there are also further problems such as the necessity of special countermeasure against dewing. Moreover, the discarding thereof is also problematic.

Similarly, the foamed plastic, etc., which is used as the buffer material, is also bulky, and there are problems such as the securing of a storage space and the discarding. Moreover, since the shape and size of the space inside the cardboard box varies according to the shape and size of the packaged object, the type of buffer material used therefor also varies, and therefore, various types of buffer materials must be provided. Moreover, the insertion work thereof into the cardboard box is also troublesome.

In the light of the above problems, it is an object of the present invention to provide a packaging material, packaging bag, packaging article and packaging method, which facilitates packaging and unpackaging of the packaged object, downsizes the storage space before/after using thereof, minimizes the used material extremely, simplifies discarding, and reduces the using amount of, or ultimately eliminates, buffer material.

Means to Solve the Problem

To achieve the objects mentioned above, according to the first aspect of the present invention, a packaging material is provided with: a packaging material body, formed into a sheet shape as a whole, by welding two film sheets consisting of an upper sheet and a lower sheet together at appropriate points; an air introduction path, provided to the packaging material body, and having one side thereof serving as an air introduction port and also having the other side sealed; a plurality of air bags, provided to the packaging material body while in communication with the air introduction path, and extending in a direction orthogonal to the air introduction path; and check valves, provided to respective air inlets of the plurality of air bags, and preventing escaping of air, having been introduced through the air introduction port and introduced into the air bags through the air inlets, wherein, the packaging material body is bent and welded at appropriate points, so as to provide a packaging bag for storing a packaged object.

Moreover, according to the packaging material of the second aspect, with regard to the packaging material as recited in the first aspect, the air bags are composed of long air bags, and short air bags provided on the left and right of the long air bags.

Moreover, according to the packaging material of the third aspect, with regard to the packaging material as recited in the second aspect; the packaging material body is formed in a rectangle sheet shape, and a part on the left and right of the long air bag without having the short air bag serves as an air unfilled part; and the air introduction path is provided on one side edge of the packaging material body.

Moreover, according to the packaging material of the fourth aspect, with regard to the packaging material as recited in the third aspect; the short air bags are provided on the left and right of the long air bags, communicating therewith via an upper communicating part and a lower communicating part; the air unfilled parts are provided at four corners of the packaging material body and at a space between each of the short air bags; the long air bags and the short air bags are configured in a shape of double-crosspiece cross shape; the check valve is provided at the air inlet of the long air bag; a part of air, having been introduced into the long air bag via the check valve, is introduced into the short air bags via the communicating parts; and the packaging material body is wholly folded into two parts from the side of the one side edge toward the side of another side edge, so as to provide the packaging bag.

Moreover, according to the packaging material of the fifth aspect, with regard to the packaging material as recited in the first aspect, the plurality of air bags of the packaging material body is provided on both sides across the airintroduction path.

Moreover, according to the packaging material of the sixth aspect, with regard to the packaging material as recited in any one of the first to fifth aspects, the plurality of air bags has been formed with air discharge openings in advance, and the plurality of air discharge openings is sealed by a peelable seal member, so that, by removing of the seal member during unpackaging, the air discharge openings are opened so as to discharge the air.

Moreover, according to the packaging material of the seventh aspect, with regard to the packaging material as recited in any one of the first to sixth aspects, the packaging material body is provided with a weakened part, and by breaking along the weakened part, an accommodated packaged object can be taken out.

Moreover, according to the packaging material of the eighth aspect, with regard to the packaging material recited in the seventh aspect, the weakened part is composed of perforations and thin parts.

Moreover, according to the packaging material of the ninth aspect, with regard to the packaging material as recited in any one the first to eighth aspects, the packaging material body is provided with bending parts functioning as bending lines during three-dimensional forming into a packaging bag, and the bending part is composed of partially welded parts configured intermittently in series.

Moreover, according to the packaging material of the tenth aspect, with regard to the packaging material as recited in any one of the first to ninth aspects, the packaging material body is provided with a sheet sticking part, and the air bags in the sheet sticking part are provided at smaller diameters and smaller intervals than those of the other air bags.

Moreover, according to the packaging material of the eleventh aspect, with regard to the packaging material as recited in any one of the first to tenth aspects, the packaging material body has openings serving as a carrying handle when constituting a packaging bag.

Moreover, a packaging bag according to the twelfth aspect is constituted by bending the packaging material as recited in any one of the first to eleventh aspects.

Moreover, according to the packaging bag of the thirteenth aspect, the packaging bag as recited in the twelfth aspect 12 is constituted, by folding the packaging material as recited in the fourth aspect into two parts from the side of the one side edge toward the side of the other side edge, and by welding the overlapping air unfilled parts with each other during constituting.

Moreover, according to the packaging bag of the fourteenth aspect, with regard to the packaging bag as recited in the thirteenth aspect, the welded air unfilled part is provided with a cutout part for unpackaging.

Moreover, according to a packaged article material of the fifteenth aspect, air is introduced into each of the air bags of the packaging bag as recited in any one of the twelfth to fourteenth aspects to be inflated, and a packaged object is accommodated in a state that interior air has been discharged.

Moreover, according to a packaging method of the sixteenth aspect: a packaged object is loaded into the packaging bag as recited in any of the twelfth to fourteenth aspects; as a next step, an opening of the packaging bag is welded to be enclosed; and as a next step, each of the air bags is inflated by introducing air into the air introduction path.

Moreover, according to a packaging method of the seventeenth aspect: a packaged object is placed on the packaging material as recited in any one the first to eleventh aspects; as a next step, the packaging material is bent, and an opening is welded to be enclosed; and as a next step, each of the air bags is inflated by introducing air into the air introduction path.

And moreover, according to the packaging method of the eighteenth aspect, with regard to the packaging method as recited in the sixteenth aspect or the seventeenth aspect, interior air is discharged.

Effect of the Invention

As described above, according to the first aspect of the present invention, a packaging material is provided with: a packaging material body, formed into a sheet shape as a whole, by welding two film sheets consisting of an upper sheet and a lower sheet together at appropriate points; an air introduction path, provided to the packaging material body, and having one side thereof serving as an air introduction port and also having the other side sealed; a plurality of air bags, provided to the packaging material body while in communication with the air introduction path, and extending in a direction orthogonal to the air introduction path; and check valves, provided to respective air inlets of the plurality of air bags, and preventing escaping of air, having been introduced through the air introduction port and introduced into the air bags through the air inlets, wherein, the packaging material body is bent and welded at appropriate points, so as to provide a packaging bag for storing a packaged object. Therefore, the complicated and physically heavy labor, which has been troublesome with the assembling and disassembling of packaging material of the conventional art using the cardboard box, is eliminated, and the packaging and unpackaging of the packaged object is facilitated.

Moreover, according to the packaging material of the second aspect, with regard to the packaging material as recited in the first aspect, the air bags are composed of long air bags, and short air bags provided on the left and right of the long air bags. Therefore, the part of the short air bags serves as a thickness part of the packaging bag, coping with any packaged object having various thicknesses.

Moreover, according to the packaging material of the third aspect, with regard to the packaging material as recited in the second aspect: the packaging material body is formed in a rectangle sheet shape, and a part on the left and right of the long air bag without having the short air bag serves as an air unfilled part; and the air introduction path is provided on one side edge of the packaging material body. Therefore, the shape as the packaging material is simplified, whereby the manufacturing of packaging material is facilitated, and the storage thereof is also facilitated.

Moreover, according to the packaging material of the fourth aspect, with regard to the packaging material recited in the third aspect: the short air bags are provided on the left and right of the long air bags, communicating therewith via an upper communicating part and a lower communicating part; the air unfilled parts are provided at four corners of the packaging material body and at a space between each of the short air bags; the long air bags and the short air bags are configured in a shape of double-crosspiece cross shape; the check valve is provided at the air inlet of the long air bag; a part of air, having been introduced into the long air bag via the check valve, is introduced into the short air bags via the communicating parts; and the packaging material body is wholly folded into two parts from the side of the one side edge toward the side of another side edge, so as to provide the packaging bag. Therefore, the above effects can be achieved more effectively.

Moreover, according to the packaging material of the fifth aspect, with regard to the packaging material as recited in the first aspect, the plurality of air bags of the packaging material body is provided on both sides across the air introduction path. Therefore, the filling of air can be accomplished more securely.

Moreover, according to the packaging material of the sixth aspect, with regard to the packaging material as recited in any one of the first to fifth aspects, the plurality of air bags has been formed with air discharge openings in advance, and the plurality of air discharge openings is sealed by a peelable seal member, so that, by removing of the seal member during unpackaging, the air discharge openings are opened so as to discharge the air. Therefore, the unpackaging work is facilitated.

Moreover, according to the packaging material of the seventh aspect, with regard to the packaging material as recited in any one of the first to sixth aspects, the packaging material body is provided with a weakened part, and by breaking along the weakened part, an accommodated packaged object can be taken out. Therefore, with this structure, the unpackaging work is also facilitated.

Moreover, according to the packaging material of the eighth aspect, with regard to the packaging material as recited in the seventh aspect, the weakened part is composed of perforations and thin parts. Therefore, with the relatively simple structure, a desired weakened part can be provided.

Moreover, according to the packaging material of the ninth aspect, with regard to the packaging material as recited in any one of the first to eighth aspects, the packaging material body is provided with bending parts functioning as bending lines during three-dimensional forming into a packaging bag, and the bending part is composed of partially welded parts configured intermittently in series. Therefore, the bending thereof is facilitated.

Moreover, according to the packaging material of the tenth aspect, with regard to the packaging material as recited in any one of the first to ninth aspects, the packaging material body is provided with a sheet sticking part, and the air bags in the sheet sticking part are provided at smaller diameters and smaller intervals than those of the other air bags. Therefore, the sticking of invoice thereto is facilitated.

Moreover, according to the packaging material the eleventh aspect, with regard to the packaging material as recited in any one of the first to tenth aspects, the packaging material body has openings serving as a carrying handle when constituting a packaging bag. Therefore, the packaging bag with the carrying handle can be provided.

Moreover, a packaging bag according to the twelfth aspect is constituted by bending the packaging material as recited in any one of the first to eleventh aspects. Therefore, it is possible to provide the packaging bag with the facilitated packaging work.

Moreover, according to the packaging bag of the thirteenth aspect, the packaging bag as recited in the twelfth aspect is constituted, by folding the packaging material as recited in the fourth aspect into two parts from the side of the one side edge toward the side of the other side edge, and by welding the overlapping air unfilled parts with each other during constituting. Therefore, it is possible to cope with relatively thin-shaped packaged objects.

Moreover, according to the packaging bag of the fourteen aspect, with regard to the packaging bag as recited in the thirteenth aspect, the welded air unfilled part is provided with a cutout part for unpackaging. Therefore, the unpackaging work is facilitated.

Moreover, according to a packaged article material of the fifteenth aspect, air is introduced into each of the air bags of the packaging bag as recited in any one of the twelfth to fourteenth aspects to be inflated, and a packaged object is accommodated in a state that interior air has been discharged. Therefore, the downsizing as the packaged article is accomplished, and unintended movement of the packaged object is also prevented.

Moreover, according to a packaging method of the sixteenth aspect: a packaged object is loaded into the packaging bag as recited in any of the twelfth to fourteenth aspects; as a next step, an opening of the packaging bag is welded to be enclosed; and as a next step, each of the air bags is inflated by introducing air into the air introduction path. Therefore, the packaging work is facilitated.

Moreover, according to a packaging method of the seventeenth aspect: a packaged object is placed on the packaging material as recited in any one of the first to eleventh aspects; as a next step, the packaging material is bent, and an opening is welded to be enclosed; and as a next step, each of the air bags is inflated by introducing air into the air introduction path. Therefore, the packaging work is facilitated.

And moreover, according to the packaging method of the eighteenth aspect, with regard to the packaging method as recited in the sixteenth or seventeenth aspect, interior air is discharged. Therefore, the downsizing as the packaged article is accomplished, and unintended movement of the packaged object is also prevented.

BRIEF DESCRIPTION OF DRAWINGS

FIG. 17 (*b*) is a plan view showing a state that the packaging material is folded into two parts so as to cover the loaded packaged object; FIG. 17 (*c*) is a sectional view as seen by the line c-c of FIG. 17 (*b*); FIG. 17 (*d*) is a plan view showing a state that three pieces of the packaging material, which has been folded into two parts, are welded; and FIG. 17 (*e*) is a plan view showing a state of filling of the air, according to the fourth embodiment of the present invention.

MODE(S) FOR CARRYING OUT THE INVENTION

Figure 18:
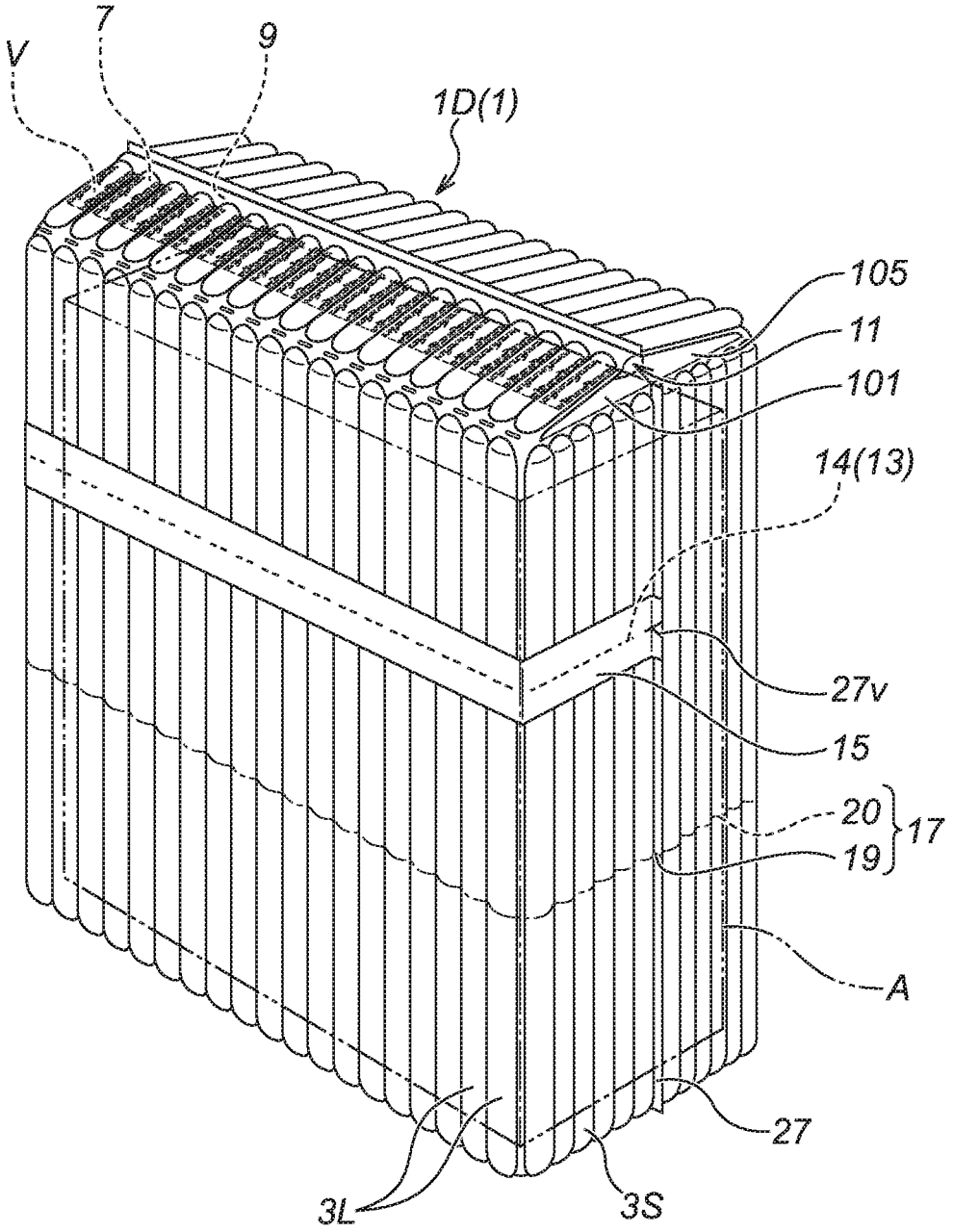
FIG. 18 is a perspective view of a packaging bag formed in a three-dimensional shape by using the packaging material, according to the fourth embodiment of the present invention.
Figure 19:
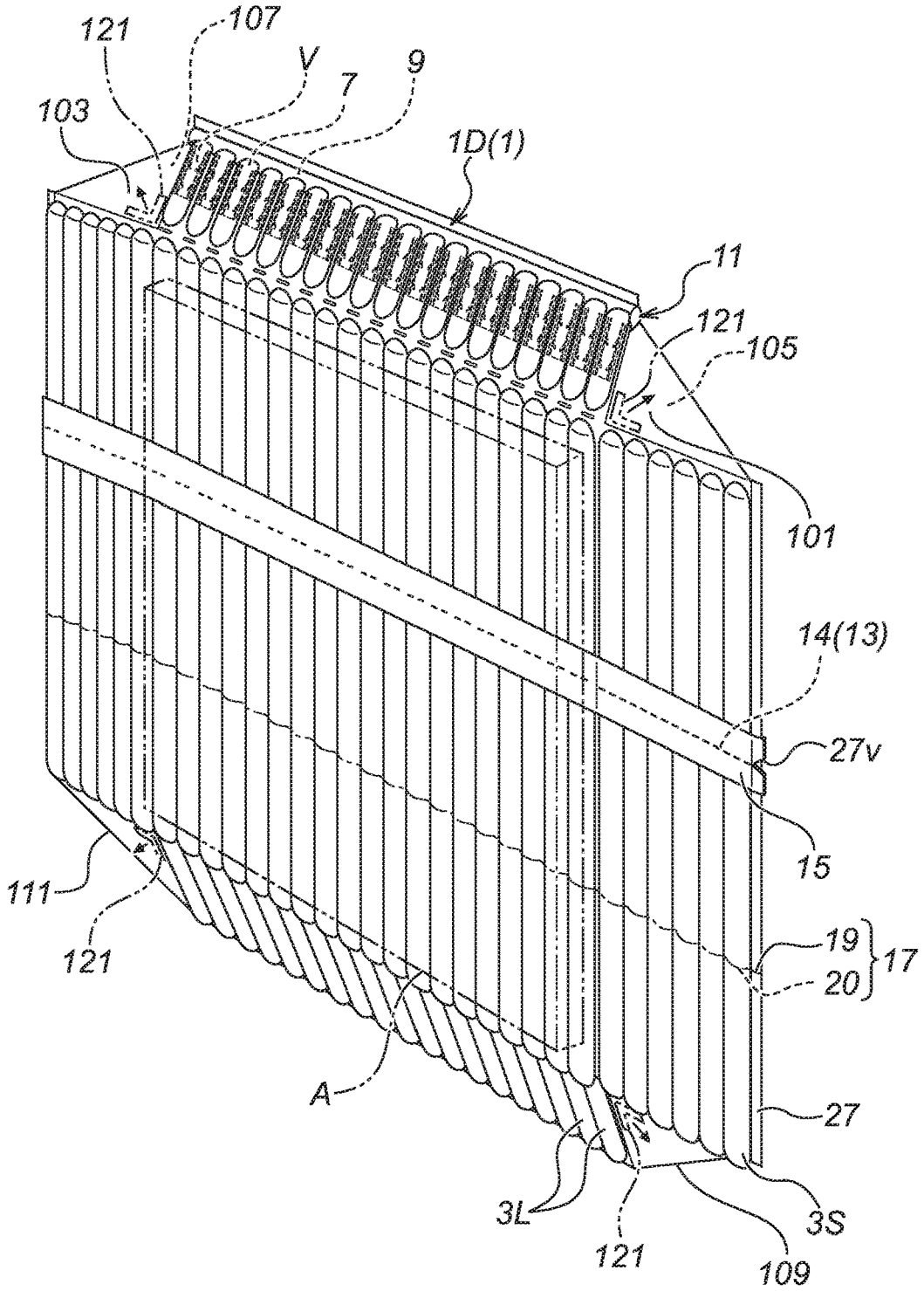
FIG. 19 is a perspective view of the packaging bag formed in the three-dimensional shape by using the packaging material, according to the fourth embodiment of the present invention.
Figure 20:
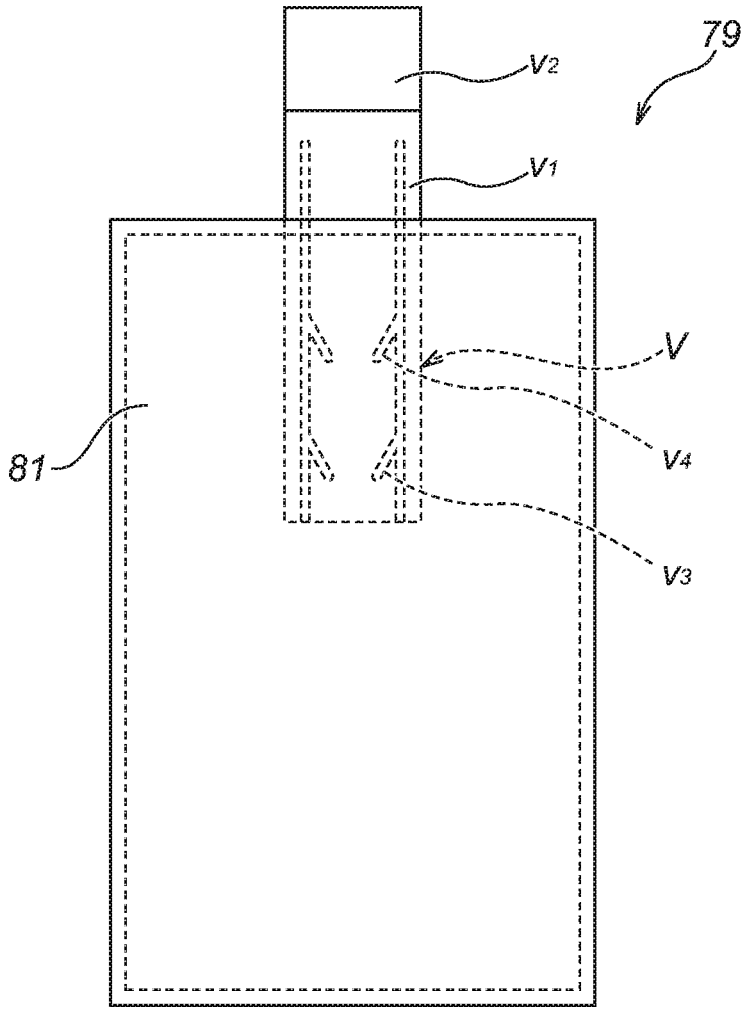
FIG. 20 is a front view of an example of a buffer material accommodated in a vacant space in a packaging bag, according to a fifth embodiment of the present invention.

Now, a packaging material according to the present invention, a packaging bag which has been formed in a three-dimensional shape by using the packaging material, a packaged article accommodating a packaged object in the packaging bag, and a packaging method for obtaining the packaged article, will be explained in detail, with regard to the structure, function and effect thereof, with reference to a first embodiment as illustrated in FIG. 1 to FIG. 5, a second embodiment as illustrated in FIG. 6 to FIG. 10, a third embodiment as illustrated in FIG. 11 to FIG. 15, a fourth embodiment as illustrated in FIGS. 16 to 19, a fifth embodiment as illustrated in FIG. 20, and a sixth embodiment as illustrated in FIG. 21 to FIG. 24, shown as examples, respectively. And finally, other embodiments having different structures from those of six embodiments will be explained.

For reference, in the first embodiment, the details of packaging material, packaging bag, packaged article and packaging method will be explained, and additionally, the unpackaging work will also be explained. Moreover, with regard to the second embodiment, the third embodiment, the fourth embodiment, the fifth embodiment and the sixth embodiment, the explanation will be focused on the difference of structures from those of the first embodiment.

[First Embodiment] (See FIG. 1 to FIG. 5)

Figure 1:
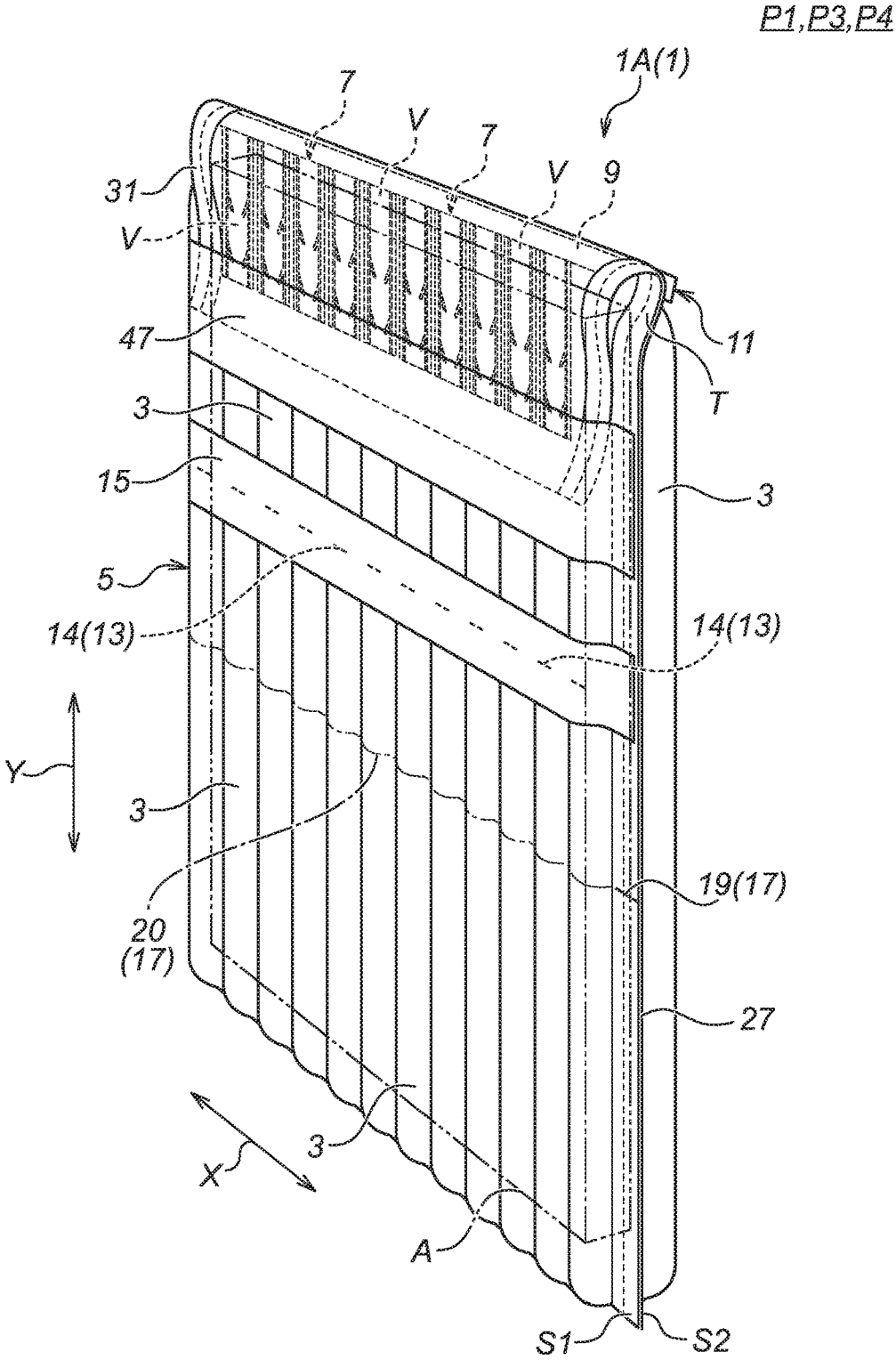
FIG. 1 is a perspective view of a packaging bag formed in a three-dimensional shape by using a packaging material, according to a first embodiment of the present invention.
Figure 2:
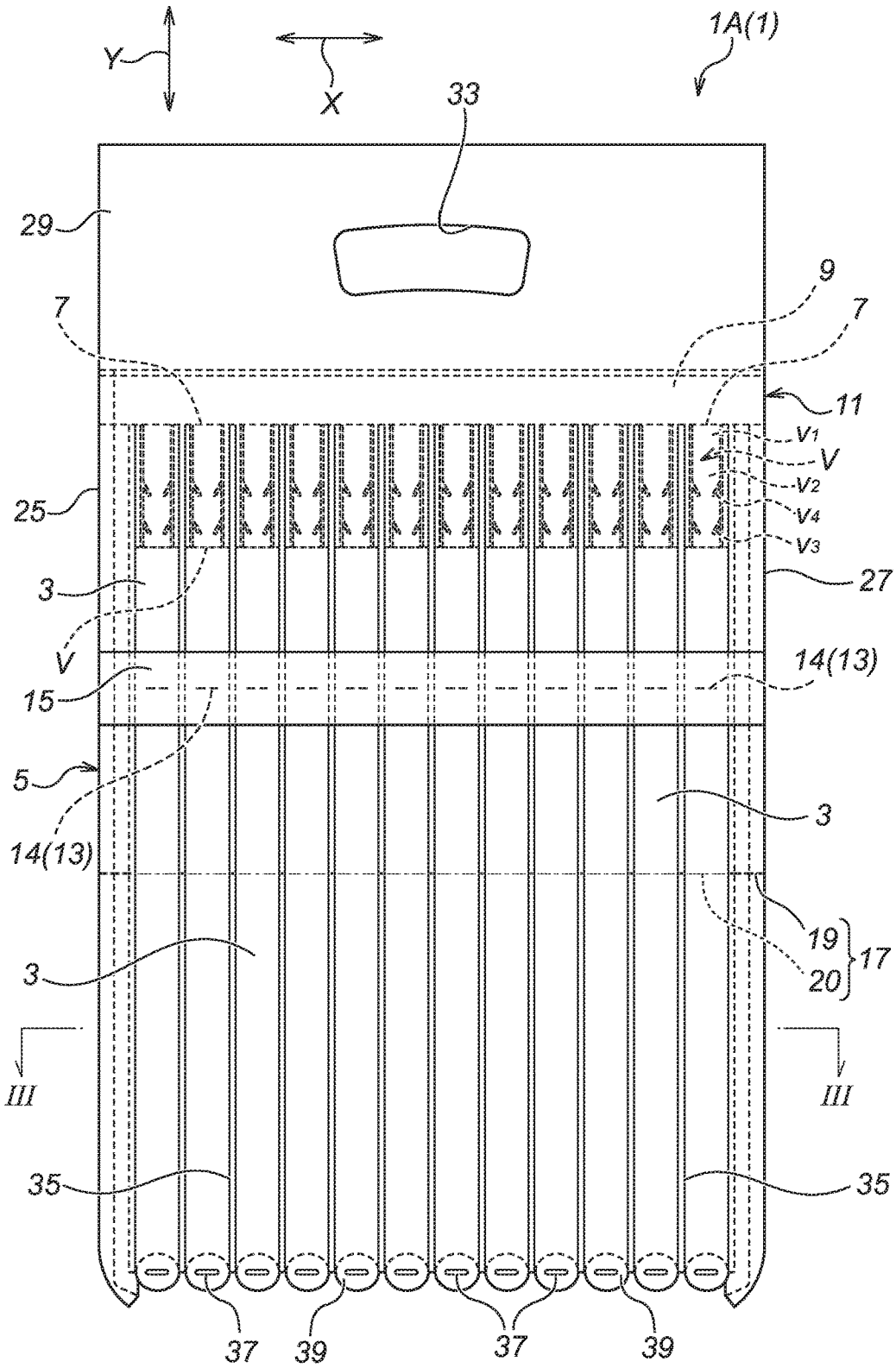
FIG. 2 is a front view of the packaging bag formed in the three-dimensional shape by using the packaging material, according to the first embodiment of the present invention.
Figure 3:
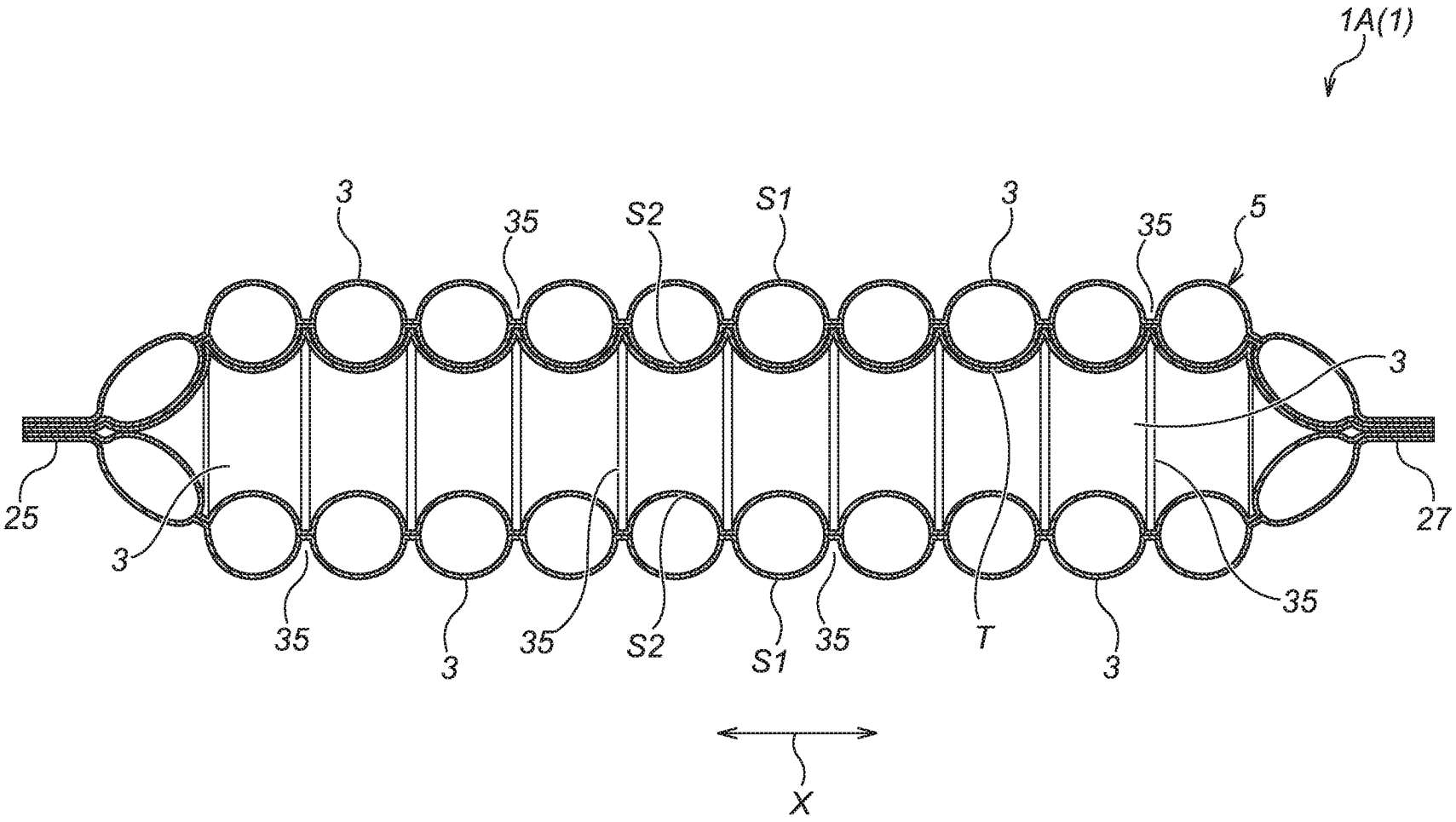
FIG. 3 is a sectional view as seen by the line III-III of FIG. 2, according to the first embodiment of the present invention.
Figure 4A:
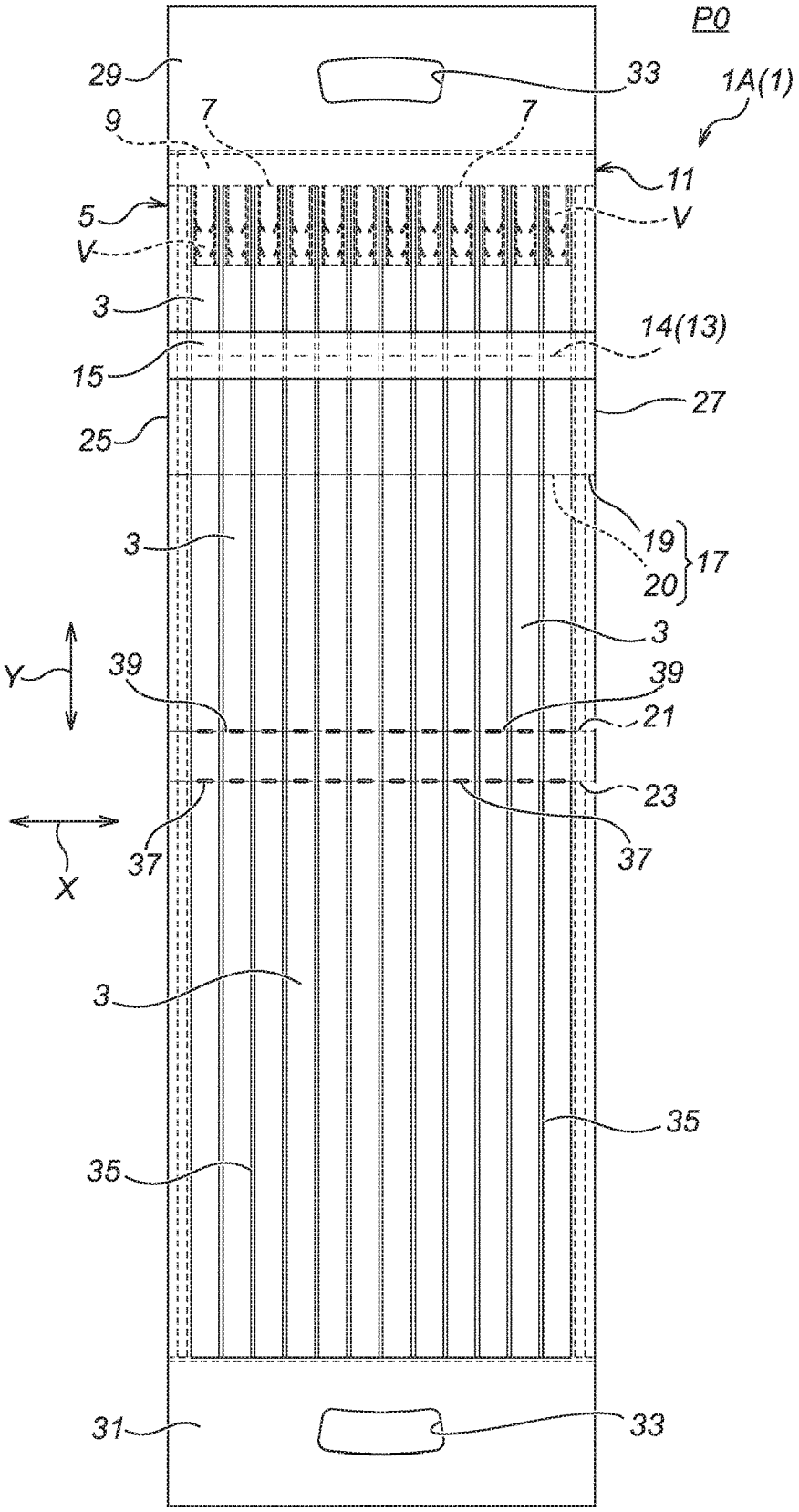
FIG. 4 (*a*) is a plan view of the packaging material in an expanded state, and FIG. 4 (*b*) is a plan view of a check valve, according to the first embodiment of the present invention.
Figure 4B:
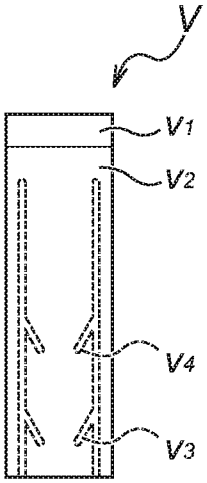

(1) Overall Structure of a Packaging Material:

As illustrated in FIG. 4, a packaging material 1 of the present embodiment is provided with a packaging material body 5, for which a raw material, having a plurality of air bags 3 provided consecutively, is used. With the three-dimensional forming of the packaging material body 5, a bag-shaped packaging bag as illustrated in FIG. 1 to FIG. 3 is obtained, and serves as a packaged article accommodating a packaged object A therein.

Moreover, each of the plurality of air bags 3 is provided with an air inlet 7, and a check valve V is installed in each of the air inlets 7.

The structure of the check valve V is substantially the same as those of the check valves disclosed, for example, in Japan Examined Patent Publication Hei 7-117171 and Japan Patent No. 3169412. Namely, as illustrated in FIG. 4 (*b*), a front wall v1 and a rear wall v2 constitute a tubular body in a flattened shape, and a primary valve flap part v3 and a secondary valve flap part v4, respectively comprising a pair of heat seal parts on the left and right, are provided between the front wall v1 and the rear wall v2. The primary valve flap part v3 and the secondary valve flap part v4 prevent the filled air from escaping. The check valve V having the above structure is fixed on one of two sheet-shaped raw materials S1, S2, of which detailed explanation will be made afterwards.

For reference, the structure of the check valve V is not limited to those in the drawing, and various types of structures may be used.

Moreover, with regard to the packaging material body 5, an air introduction path 9, in communication with each of the air inlets 7 of the plurality of the air bags 3 is provided, and an arbitrary number of (in the present embodiment, one) air introduction port(s) 11 is provided in the air introduction path 9.

Further, air discharge openings 13 have been formed in advance in the plurality of air bags 3, and the plurality of air discharge openings 13 is sealed by a seal member 15, which is peelable during unpackaging.

Moreover, the packaging material body 5 is provided with a weakened part 17, which is composed, as an example, of perforations 19 and line-shaped thin parts 20, and by breaking the packaging material body 5 along the weakened part 17, the accommodated packaged object A is taken out.

(2) Specific Structure of the Packaging Material, and the Function and Effect Thereof:

As illustrated in FIG. 3, a packaging material 1A according to the present embodiment, is a packaging material using a raw material composed of two sheet-shaped raw materials S1, S2 sticking to each other, made of, for example, synthetic resin films, and as illustrated in FIG. 4, is composed of, for example, twelve air bags 3 extending in the lengthwise direction Y, provided consecutively in the widthwise direction X. The packaging material 1A in this structure is bent along bending lines 21, 23, respectively, to form a shape of the letter "U," and by welding rims of the side edges 25, 27 on the left and right side, as illustrated in FIG. 1 to FIG. 3, a three-dimensional forming as a packaging bag in a bag shape is performed. Moreover, by accommodating the packaged object A, this packaging bag serves as a packaged article.

For reference, as an example of the synthetic resin film, a three-layer film comprising PE (polyethylene)/PA (polyamide)/PE may be used. Each film layer is adhered to each other via adhesive, but it is of course not limited to this structure, and various types of synthetic resin films may be used. Moreover, the color thereof is not limited either.

Moreover, the both ends of the air bags 3 in the lengthwise direction Y are formed, for example as rectangle sheet pieces 29, 31, respectively, in which the air bags 3 are not formed. Holes 33, 33 are formed, respectively, at the center of each of the sheet pieces 29, 31, used as carrying handles during carrying by hand. The sheet pieces 29, 31 are overlapped with each other, and the overlapping holes 33, 33 serve as the carrying handle.

Moreover, one end part of each of the air bags 3 is provided with the air introduction path 9 extending in the widthwise direction X, and as an example, the air introduction port 11, used for introducing an air G into the air introduction path 9, is formed at one end part of the air introduction path 9 in the widthwise direction X.

Figure 5:
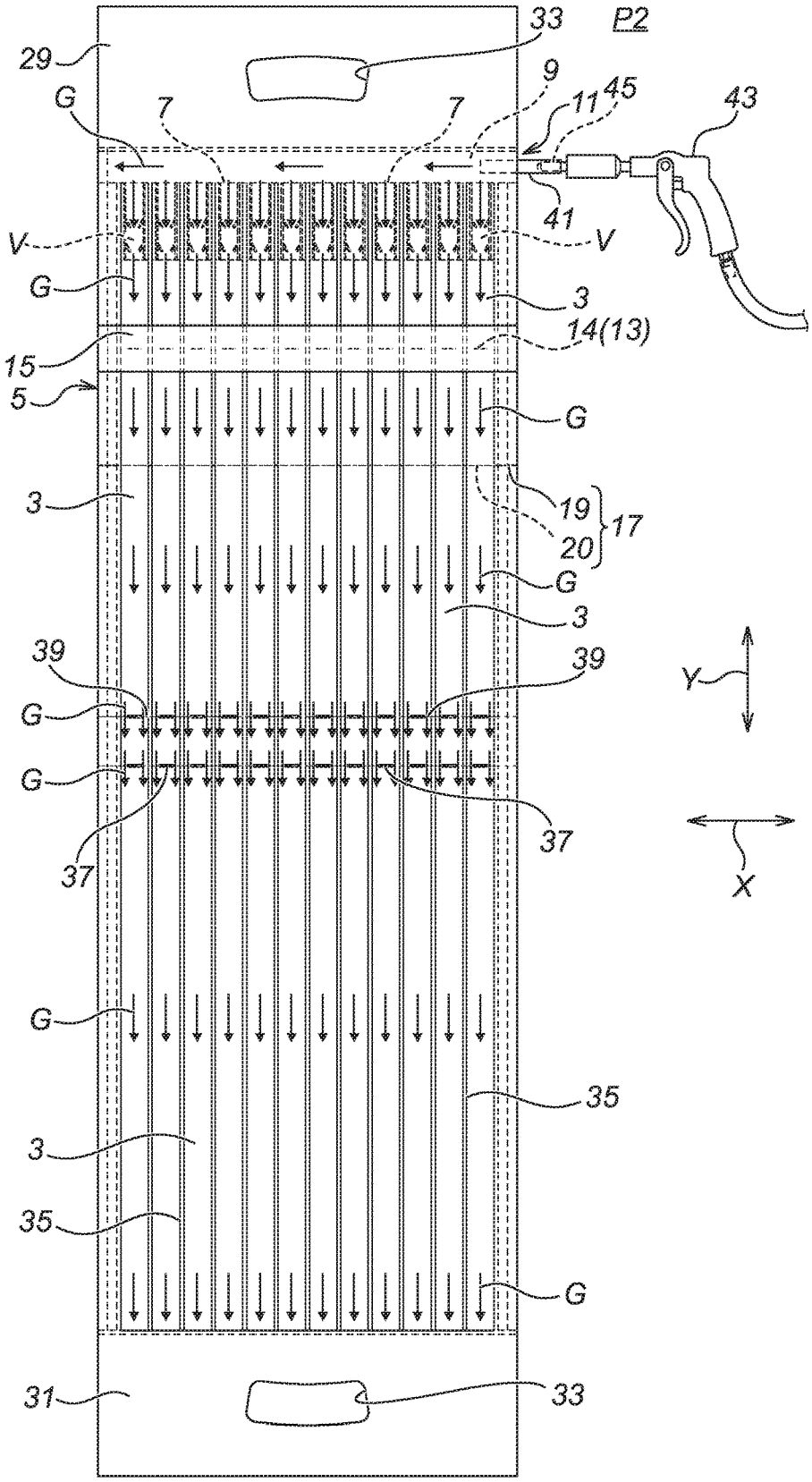
FIG. 5 is a plan view, showing the packaging material in the expanded state, and simultaneously showing the flow of air introduced into each of the air bags, according to the first embodiment of the present invention.

Moreover, another end part of the air introduction path 9 in the widthwise direction X is closed, and the air G introduced from the air introduction port 11 flows, as illustrated in FIG. 5, from the air inlet 7 of the air bag 3 into each of the check valves V, and with the opening of the check valve V, flows into the air bag 3 to be filled.

For reference, the air G, once flowed into the air bag 3, will not escape to the outside because of the function of the check valve V.

Moreover, according to the present embodiment, as illustrated in FIG. 3, while formed three-dimensionally as the packaging bag in a shape of bag, a separate sheet-shaped raw material T for reinforcing purpose, for example, is stuck to an inside of a part serving as an inner surface side.

For reference, in the present embodiment, the sheet-shaped raw material S1, S2 are formed by a transparent raw material having a good visibility, and the separate sheet-shaped raw material T for reinforcing purpose is formed by a non-transparent, for example white, raw material having a poor visibility.

Of course, the present embodiment is not limited to this structure, and as an example, the sheet-shaped raw materials S1, S2 themselves may be in black color, having a poor visibility. This is because of the prevention purpose of the packaged object A from being seen from the outside in a packaged state.

Moreover, in the present embodiment, the air discharge openings 13, and the perforations 19 and the line-shaped thin parts 20, constituting the weakened part 17, are provided, for example, on an outer surface in the widthwise direction X of the packaging material body 5.

For reference, the air discharge opening 13 is composed of, for example, slits 14 provided in each of the air bags 3, and by sticking the tape-shaped seal member 15 in the widthwise direction X so as to conceal the all slits 14, the escape of the air G from the slits 14 is prevented.

Moreover, the perforations 19 are provided in welded parts 35, each of which partitions the air bags 3 in the widthwise direction X, and the line-shaped thin parts 20 are provided so as to traverse the surface of each of the air bags 3.

Moreover, in the present embodiment, each of the bending lines 21, 23, which serves as the bending part during three-dimensional forming of the packaging material body 5 into the bag-shaped packaging bag, is provided with partially welded parts 37 thereon intermittently. The partially welded parts 37 function as the bending lines during bending of the packaging material body 5, whereby the three-dimensional forming of the packaging material body 5 into the bag-shaped packaging bag is facilitated.

Meanwhile, side spaces of the partially welded parts 37 serve as communicating openings 39, 39, to allow communication of the air G, and therefore, there is no obstacle to the filling of the air G into the air bag 3.

According to the packaging material 1A having the structure of the present embodiment as described above, the complicated and physically heavy labor for assembling and disassembling of a conventional cardboard box, is eliminated, and the packaging and unpackaging of the packaged object A is facilitated.

Moreover, since the packaging material 1A before packaging is in a shape of sheet, and will not require any large storage space.

Moreover, with the discharge of the air G, which has been filled in the air bag 3, the packaging bag can be folded up to be in a small size, and discarding thereof is simplified.

Moreover, because of buffer effect of the air bag 3, it is possible to reduce the number of separate buffer materials used therefor, or to ultimately eliminate the use of separate buffer material.

(3) Details of a Packaging Method, and Packaging and Unpackaging Procedures:

Basically, the packaging method according to the present embodiment is composed of four processes, namely, a three-dimensional forming process P1, an air filling process P2, a loading process P3, and a sealing process P4, and according to the present embodiment, by also including a two-dimensional forming process P0, which is executed as a preparation process for the three-dimensional forming process P1, the packaging method is composed of five processes.

Now, with reference to an exemplary case in which the packaging material 1A according to the first embodiment is used, together with the explanation of packaging and unpackaging procedures by using the packaging material 1A, the details of packaging method in the present embodiment will be explained specifically.

<During Packaging>

(A) Two-Dimensional Forming Process (See FIG. 4):

The two-dimensional forming process P0 is a process, in which, the two sheet-shaped raw materials S1, S2, namely the upper and the lower sheet-shaped raw materials, respectively, are welded, and by using the raw material in which the plurality of air bags 3 is provided consecutively, the packaging material body 5 in an expanded state, in a predetermined shape, is formed.

In this process, two sheet-shaped raw materials S1, S2, serving as the upper and lower sheet-shaped raw materials, respectively, are overlappingly placed, and are welded, except for the portion in which the air bags 3 and the air introduction paths 9 are formed, and also except for the portion in which the communicating openings 39, 39 along the bending lines 21, 23. Thereafter, the perforations 19 are formed at predetermined positions in the welded parts 35, which have been formed at spaces between the pair of air bags 3 consecutively provided in the widthwise direction X, and the line-shaped thin parts 20 are formed on the surface thereof, so as to traverse the air bags 3.

Moreover, with regard to the upper and lower two sheet-shaped raw materials S1, S2, serving as the upper and lower sheet-shaped raw materials, respectively, one of the sheet-shaped raw materials has been provided with the slits 14 formed before welding, serving as the air discharge openings 13 at predetermined positions, and the peelable seal member 15 is stuck thereto so as to conceal the slits 14.

Moreover, the check valves V have been disposed at the all portions in which the air inlets 7 of the air bags 3 have also been formed, and during welding, are welded integrally to be interposed between the two sheet-shaped raw materials S1, S2, serving as the upper and lower sheet-shaped raw materials, respectively. Further, two sheet-shaped raw materials S1, S2, serving as the upper and lower sheet-shaped raw materials, respectively, and the separate sheet-shaped raw material T for reinforcing purpose, constitutes the two sheet-shaped pieces 29, 31, serving as the upper and lower sheet-shaped pieces, respectively, and the holes 33, 33 are formed therein.

For reference, the holes 33 may have been formed, before welding of the two sheet-shaped raw materials S1, S2, and the separate sheet-shaped raw material T for reinforcing purpose.

(B) Three-Dimensional Forming Process (See FIG. 1 to FIG. 3):

The three-dimensional forming process P1 is a process, in which, after appropriate bending of the packaging material body 5 from the expanded state, by welding the side edges 25, 27, the three-dimensional forming of the packaging bag in the bag shape is performed.

In this process, the bending lines 21, 23, in which the partially welded parts 37 have been formed, are bent as the bending parts, so as to form the letter of "U," and the side edges 25, 27 on the left and right, which are now positioned at the outer surface side and the inner surface side, respectively, are welded at the rim thereof, so as to form the three-dimensional packaging bag in the bag shape.

For reference, the upper parts of the side edges 25, 27 on the left and right, in which the sheet pieces 29, 31 are included, respectively, are left in a separate state without welding.

(C) Air Filling Process (see FIG. 5):

The air filling process P2 is a process, in which, the air G is filled in each of the air bags 3 of the packaging material body 5, so as to inflate thereof from the expanded state or the three-dimensional shape. Therefore, this process may be executed after the two-dimensional process P0 as described above, or may be executed after the three-dimensional process P1 as described above, or may be executed after the loading process P3 or the sealing process P4, each of which will be described afterwards.

For reference, the execution after the sealing process P4, i.e. the execution as the final process, will improve the workability of other previous works.

In this process, a straw-shaped air injection pipe 41 is inserted into the air introduction port 11 provided at one end part of the air introduction path 9, and for example, a nozzle 45 of an air gun 43 is inserted into the air injection pipe 41. Thereafter, the air G is supplied from a compressor or air chamber, etc. (not shown), whereby the air G is forwarded and filled, from the air introduction port 11 into the air introduction path 9, and further, from the air inlet 7 into the air bag 3.

For reference, although the partially welded parts 37 are provided at the halfway of the air bag 3, since the communicating opening 39, 39 have been provided on the side portions of the partially welded part 37, the filling of the air G can be processed without any obstacle.

After completion of filling of the air G, the air injection pipe 41 and the air gun 43 are detached.

For reference, the air G, which has been filled in the air bag 3, may move from the air inlet 7 toward the air introduction path 9 so as to escape therefrom. However, since the check valve V as described above is provided at the part in which the air inlet 7 has been provided, the escape of the air G to the outside is prevented, and the air bag 3 remains the inflated state.

(D) Loading Process (See FIG. 1):

In the loading process P3, the packaged object A is loaded into the packaging bag in the three-dimensional shape.

For reference, with regard to the packaged object A, as described above, various articles, for example foods and beverages such as eggs, tofu, vegetables, fruits or milk, or daily commodities such as garment or furniture, or fragile articles, such as electronic parts, precision instruments or semiconductors, and further, books such as magazines, and pictures, etc., may be applied.

(E) Sealing Process (See FIG. 1):

The sealing process P4 is a process, in which, the packaging bag in the three-dimensional shape, into which the packaged object A has been loaded, is sealed.

In this process, the sheet pieces 29, 31 in the overlapped state are turned over, toward the outer surface side or the inner surface side, and the sheet pieces 29, 31 are sealed, by using a wide adhesive tape 47, etc., for packaging purposes, in an overlapped state with another part of the packaging material body 5. With this sealing process, the packaged article, in which the packaged object has been accommodated in the packaging bag, is obtained.

For reference, other than the sealing by the adhesive tape 47, it is also possible to carry out enclosing by welding, and other various sealing means and enclosing means can be used.

<During Unpackaging>

When the packaged article, which has been packaged in the above process, is unpackaged so as to take out the packaged object A from the packaging bag, a user place the fingers at the part in which the perforations 19 and the line-shaped thin parts 20 have been formed, and by simply pressing the fingers a little bit strongly, the perforations 19 and the line-shaped thin parts 20 are broken, whereby a big opening can be formed from the outer surface side toward the inner surface side of the packaging bag. Thus, the packaged object A can be taken out easily from the opening formed accordingly. At that time, since the air in the air bag 3 is also discharged, the packaging bag can be formed into a flat and small shape, and the discarding is carried out in such a shape.

Moreover, the packaged object A may also be taken out by removing the adhesive tape 47, etc., by which the upper part of the packaging bag has been sealed. Thereafter, when the packaging bag after using is discarded, the seal member 15 is peeled from the packaging bag so that the air discharge openings 13, composed of the slits 14, become the open state, and by discharging the filled air G completely from the air bag 3, the packaging bag is formed into a flat and small shape.

According to the packaging method of the present embodiment in the structure as described above, after appropriate bending of the packaging material body 5 from the expanded state, by simply welding the side edges 25, 27 partially or wholly, the three-dimensional forming of the packaging bag in the bag shape can be carried out, the complicated and physically heavy labor, which has been troublesome with the assembling of packaging material of the conventional art using the cardboard box, is eliminated, and the packaging of the packaged object A is facilitated.

Moreover, this is also true to the case of unpackaging, and the complicated disassembling of the cardboard box is eliminated, and the discarding thereof is also facilitated.

Moreover, in the air filling process P2, with the filling and inflation of the air G into the air bag 3, the function as the buffer material can be added to the air bag 3, whereby it is possible to reduce the number of separate buffer materials used therefor, or to ultimately eliminate the use of separate buffer material.

For reference, in the present embodiment, although the packaged object A is loaded into the packaging bag, which has been formed in the three-dimensional shape, it is also possible to place the packaged object A on the packaging material body 5 in the expanded state.

Moreover, although repeating, the air G is filled into each of the air bags 3 of the packaging material body 5, which has been in the expanded state or in the three-dimensional shape, so as to inflate thereof. However, the air G may also be filled after the sealing process P4.

Further, the order of each process may be changed arbitrarily.

Moreover, during enclosing by welding, it is also possible to discharge the air from the inside.

[Second Embodiment] (See FIG. 6 to FIG. 10)

(1) Overall Structure of a Packaging Material, Details of a Packaging Method, and Packaging and Unpackaging Procedures:

Since the overall structure of the packaging material 1, the details of the packaging method, and the packaging and unpackaging procedures, are substantially the same as those of the first embodiment described above, the detailed explanation thereof will not be made here. Now, the overall structure of a packaging material 1B according to a present embodiment, and the function and effect thereof, which are different from those of the packaging material 1A of the first embodiment, will be chiefly explained.

Figure 9:
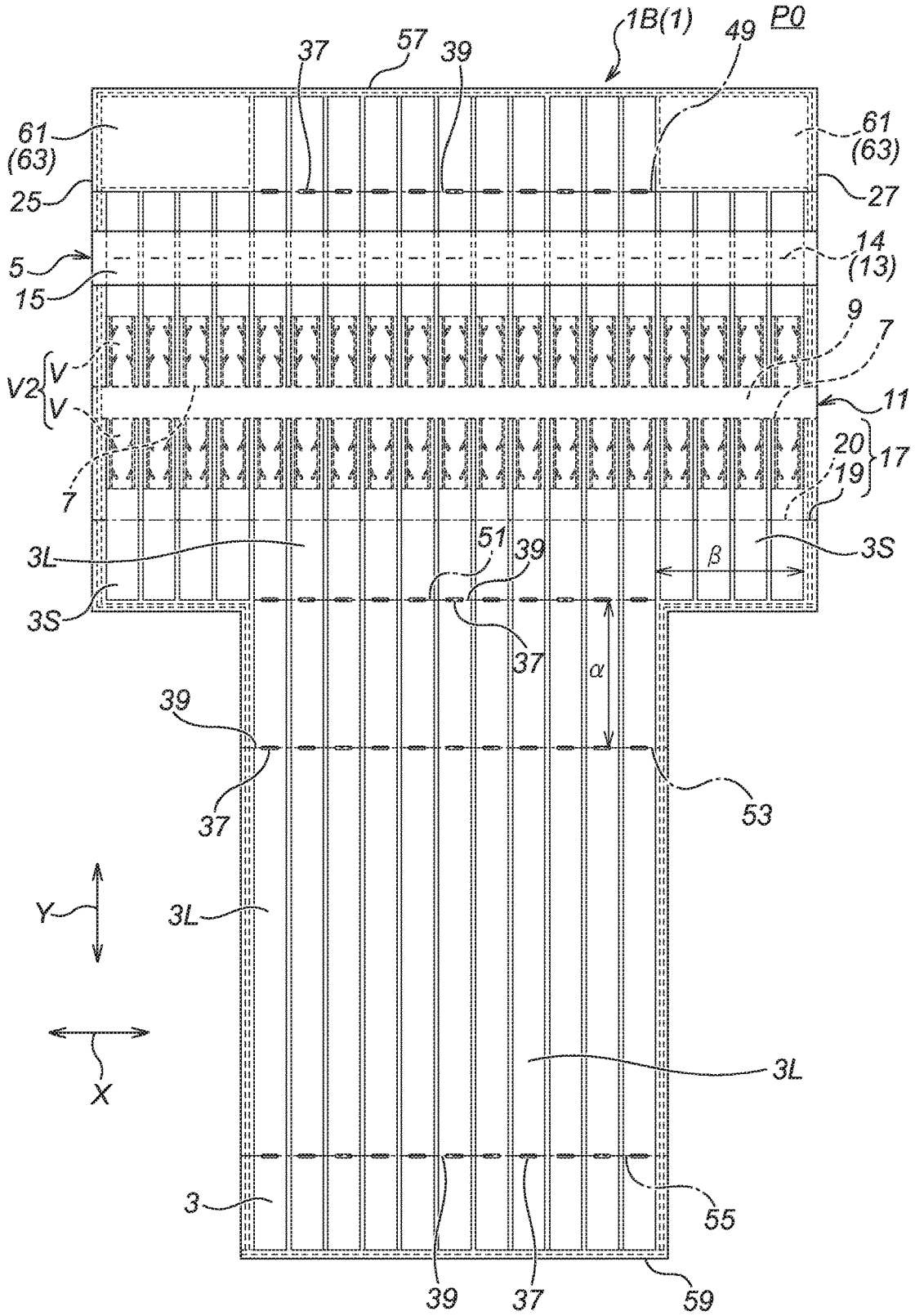
FIG. 9 is a plan view of the packaging material in an expanded state, according to the second embodiment of the present invention.

(2) Specific Structure of the Packaging Material, and the Function and Effect Thereof:

The packaging material 1B is, likewise the case of the packaging material 1A of the first embodiment, a packaging material using a raw material composed of two sheet-shaped raw materials S1, S2 sticking to each other, made of, for example, synthetic resin films, and as illustrated in FIG. 9, is composed of, for example, nineteen air bags 3 extending in the lengthwise direction Y, provided consecutively in the widthwise direction X. Among these nineteen air bags 3, eleven air bags at the center are long air bags 3L, and respective four air bags, each provided on the left and right in the upper part, are short air bags 3S. The upper parts of the short air bags 3S are provided with air unfilled parts 61, 61, in which the air G has not been filled.

Figure 6:
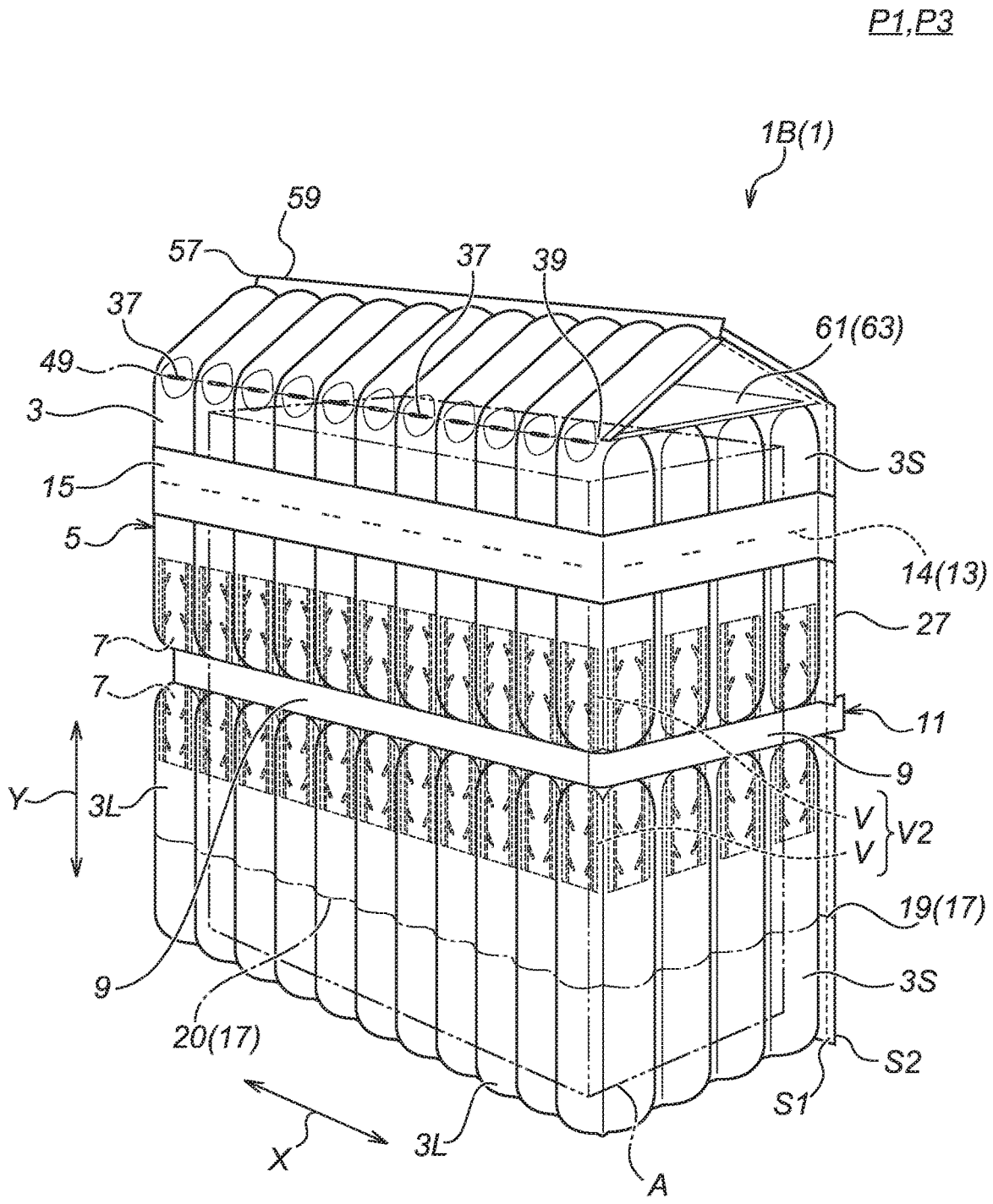
FIG. 6 is a perspective view of a packaging bag formed in a three-dimensional shape by using a packaging material, according to a second embodiment of the present invention.
Figure 7:
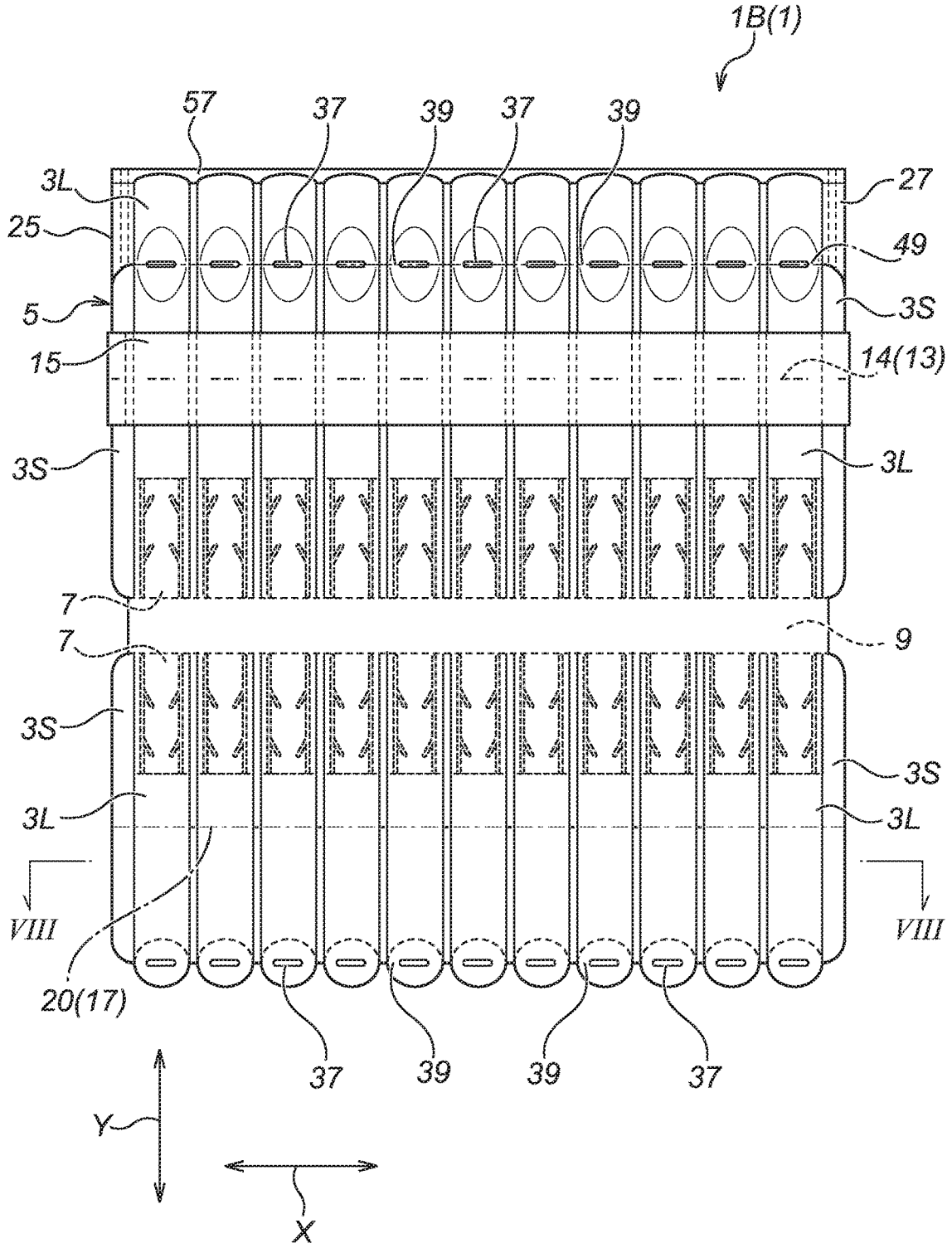
FIG. 7 is a front view of the packaging bag formed in the three-dimensional shape by using the packaging material, according to the second embodiment of the present invention.
Figure 8:
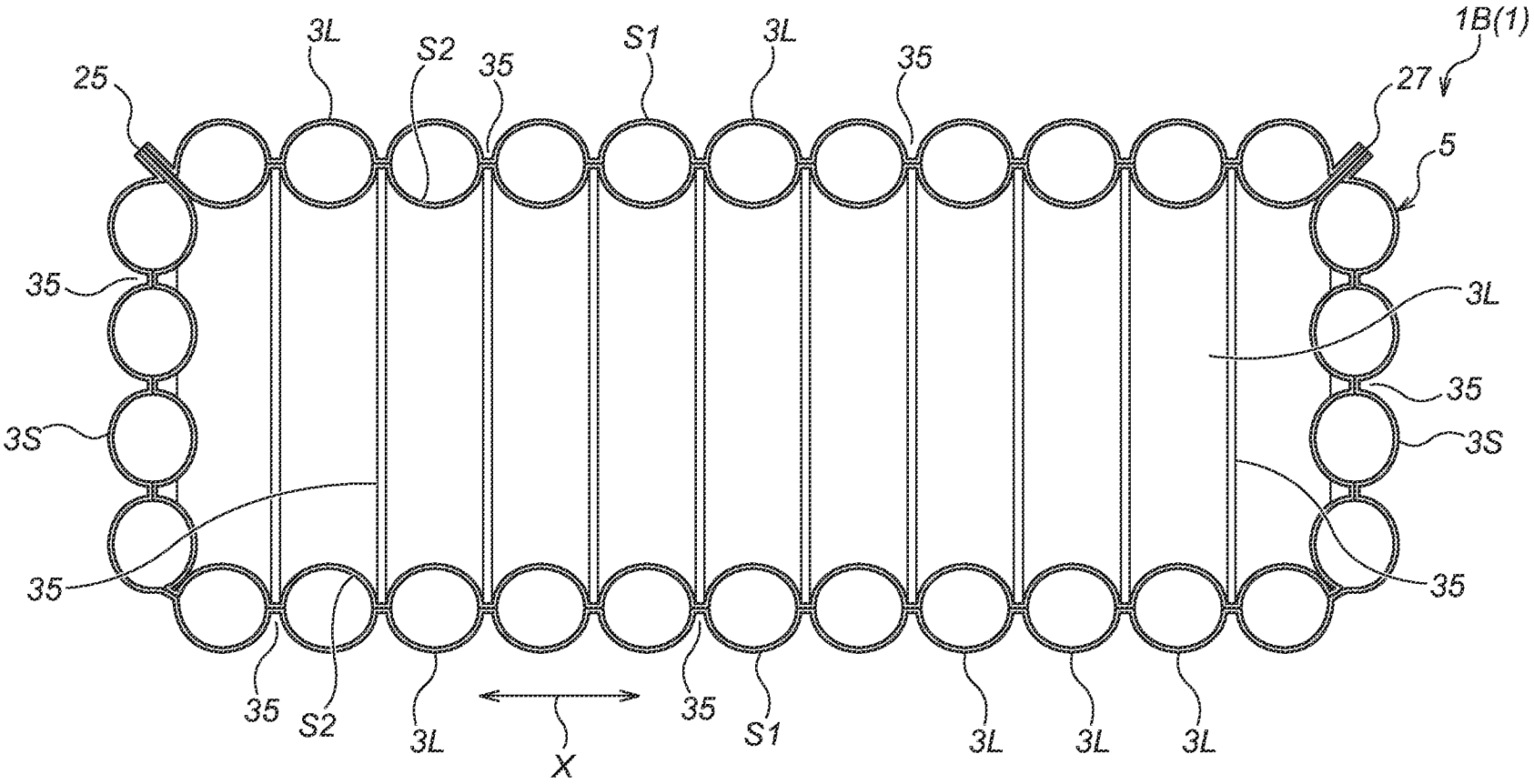
FIG. 8 is a sectional view as seen by the line VIII-VIII of FIG. 7, according to the second embodiment of the present invention.

Thus, the packaging material 1B having the above structure is bent along bending lines 49, 51, 53, 55 to form a rectangle shape, and by partially welding the rims of the side edges 25, 27 on the left and right, and also by partially welding the rims of end side edges 57, 59 at the top and bottom, as illustrated in FIG. 6 to FIG. 8, a box-shaped packaging bag is obtained.

For reference, when the packaging material body 5 is formed three-dimensionally to constitute the packaging bag, as illustrated in FIG. 6, the air unfilled parts 61, 61 serve as folded parts 63, 63.

Moreover, as illustrated in FIG. 6 to FIG. 8, parts of the packaging material body 5, which serve as a front surface and side surfaces on the left and right when formed three-dimensionally so as to constitute the box-shaped packaging bag, are provided with the air introduction path 9, for example at a position around an intermediate height, extending in the widthwise direction X toward the rear side on the left and right, so as to form the letter "U." Moreover, the air introduction port 11, used for introducing the air G into the air introduction path 9, is formed, for example, at one end part positioned at a corner part on the rear right side of the air introduction path 9.

Moreover, another end part positioned at the corner part on the rear left side of the air introduction path 9 is closed. Moreover, as also illustrated in FIG. 9, each of the long air bags 3L and the short air bags 3S, respectively configured in series in upward and downward directions, interposing the air introduction path 9, is provided with the air inlets 7, 7 both at the upper side and the lower side thereof, and each of the air inlets 7, 7 is provided with the check valves V, V, respectively, and the pair of check valves V, V constitutes a bidirectional check valve V2.

For reference, the structure of the check valve V is substantially the same as that of the first embodiment.

Figure 10:
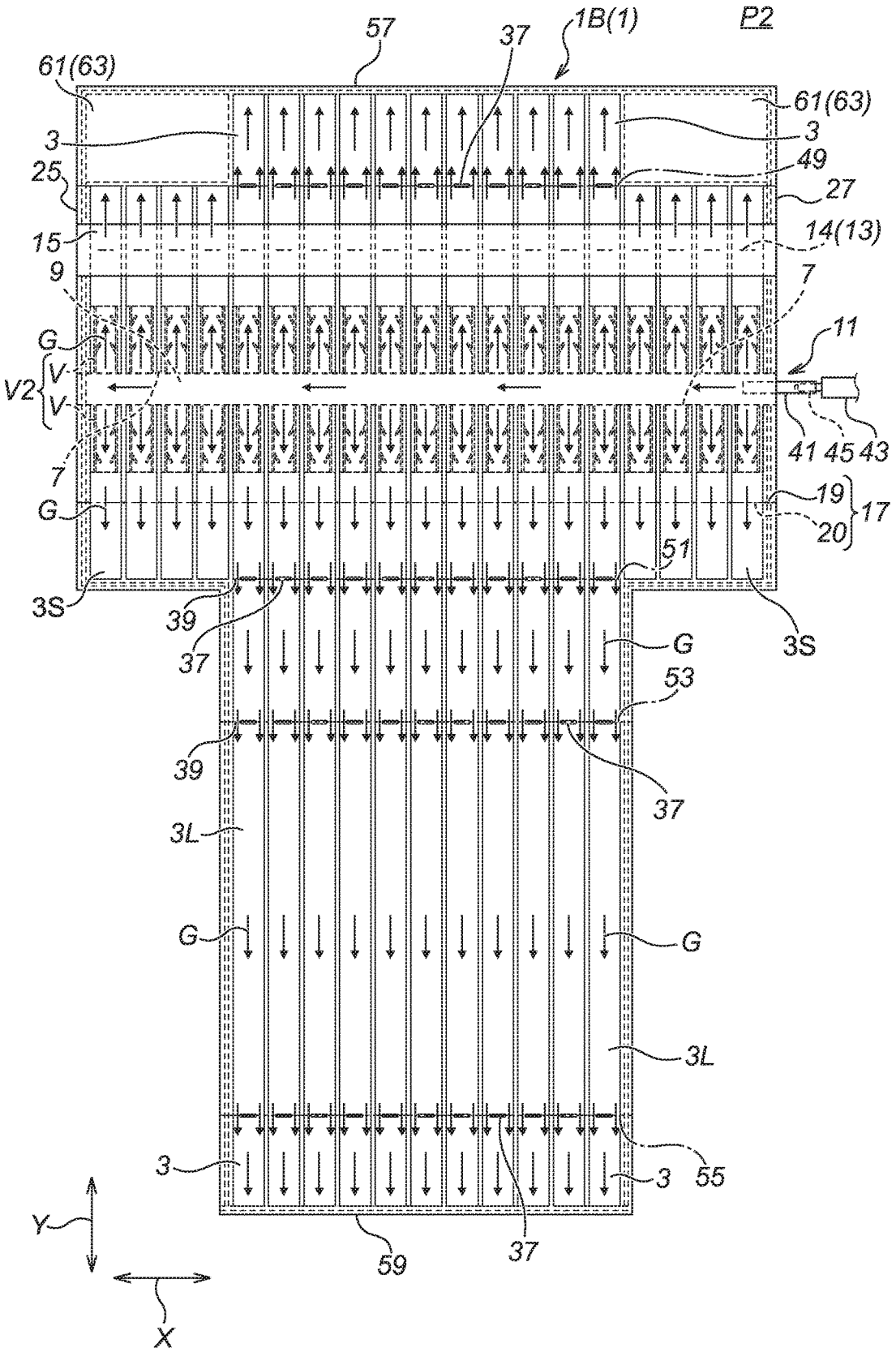
FIG. 10 is a plan view, showing the packaging material in the expanded state, and simultaneously showing the flow of air introduced into each of the air bags, according to the second embodiment of the present invention.
Figure 11:
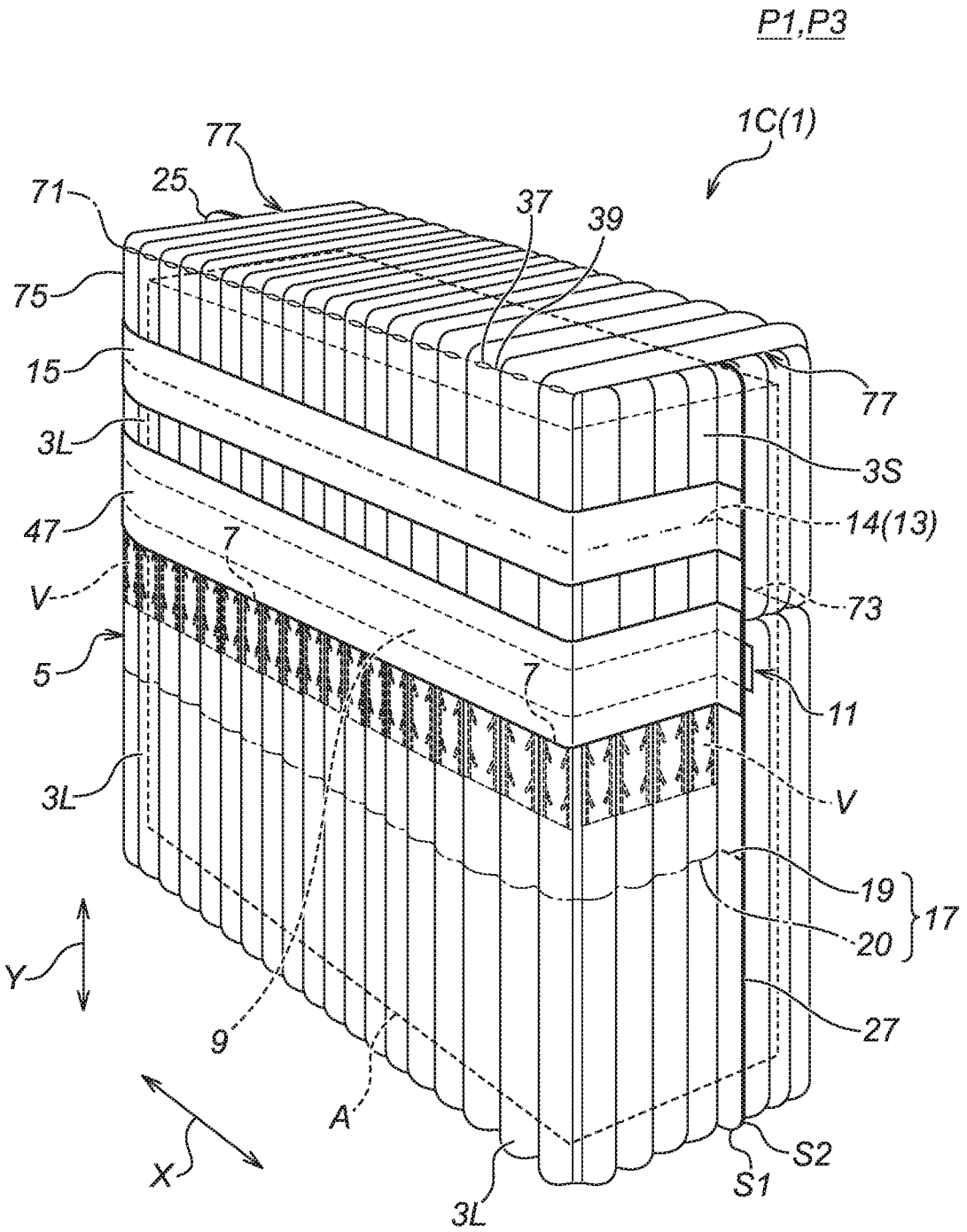
FIG. 11 is a perspective view of a packaging bag formed in a three-dimensional shape by using a packaging material, according to a third embodiment of the present invention.
Figure 12:
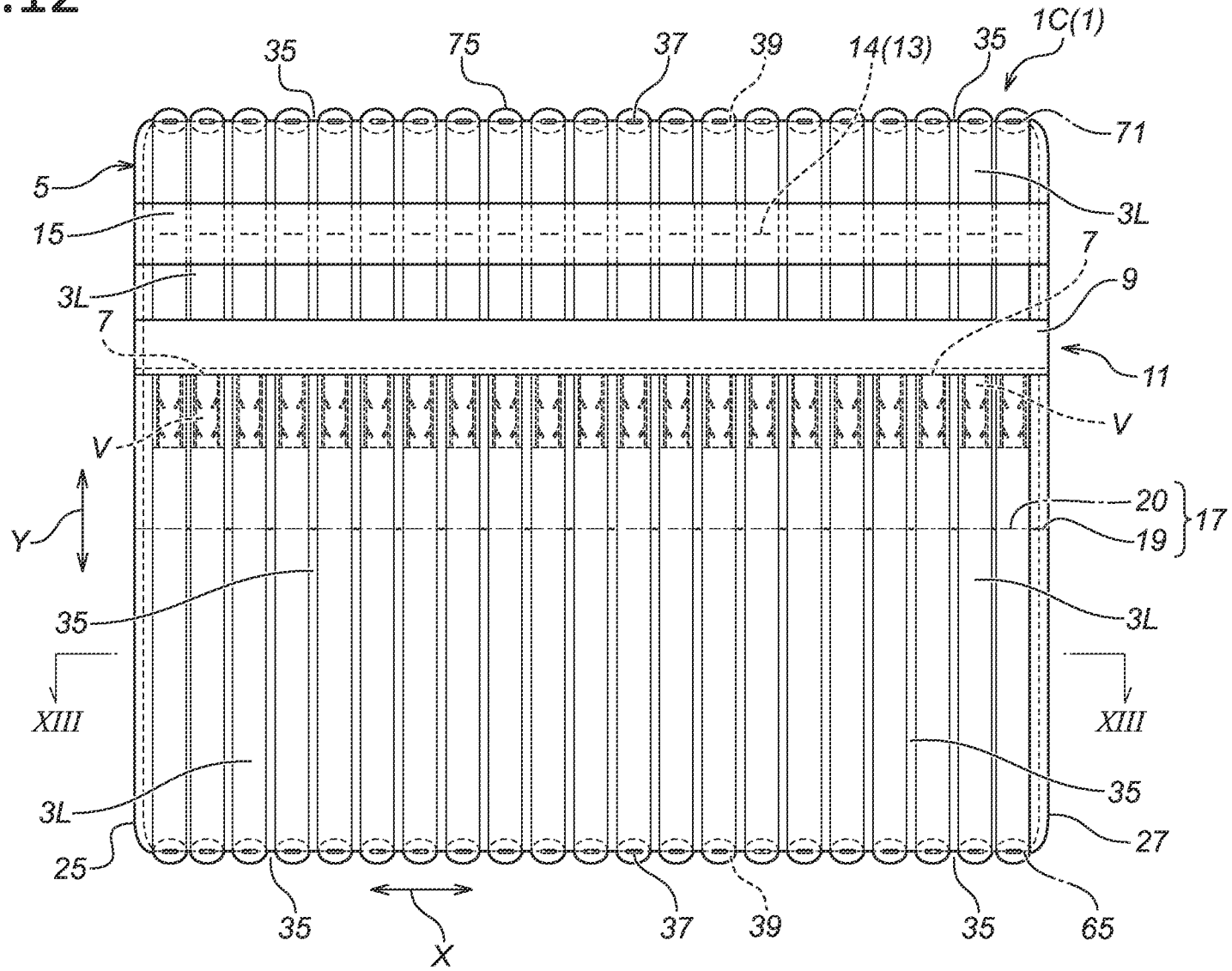
FIG. 12 is a front view of the packaging bag formed in the three-dimensional shape by using the packaging material, according to the third embodiment of the present invention.

Thus, as illustrated in FIG. 10, the air G introduced from the air introduction port 11, flows from the air inlet 7 of each of the long air bags 3L and the short air bags 3S, to reach the bidirectional check valve V2, and by opening the check valves V, V on the upper side and the lower side, which constitute the bidirectional check valve V2, further flows in two directions upwardly and downwardly, into each of the long air bags 3L and the short air bags 3S, to be filled therein.

For reference, likewise the case of the first embodiment as described above, the air G, once flowed into each of the long air bags 3L and the short air bags 3S, will not flow in the reverse directions because of the function of the check valve V, and remains in the air bag 3 so as to maintain the filled state.

Moreover, according to the present embodiment, the slits 14 serving as the air discharge openings 13, and the perforations 19 and the line-shaped thin parts 20 serving as the weakened part 17 are provided, for example, on the upper side on the lower side by interposing the air introduction path 9 therebetween, parallel to the air introduction path 9.

For reference, the area in the widthwise direction X in which the slits 14, the perforations 19 and the line-shaped thin parts 20 are provided, is substantially the same area in the widthwise direction X in which the air introduction path 9 is provided.

Moreover, with regard to the slits 14, likewise the case of the first embodiment as described above, by sticking the tape-shaped seal member 15 concealing the all slits 14, the escape of the air G from the slits 14 is prevented.

Moreover, also likewise the case of the first embodiment, the perforations 19 are formed in the welded parts 35, each of which partitions the long air bags 3L and the short air bags 3S, and the line-shaped thin parts 20 are formed on the surfaces of the long air bags 3L and the short air bags 3S so as to traverse these air bags.

Moreover, also likewise the case of the first embodiment, in the present embodiment, the partially welded parts 37 are provided along the bending lines 49, 51, 53, 55, serving as the bending parts, respectively, during the three-dimensional forming of the packaging material body 5 so as to form the box-shaped packaging bag.

It should be noted that, because of the presence of the partially welded parts 37, the partially welded parts 37 function as the bending lines during bending of the packaging material body 5, whereby the three-dimensional forming of the packaging material body 5 into the box-shaped packaging box is facilitated.

Meanwhile, the side spaces on the left and right of the partially welded parts 37 serve as the communicating openings 39, 39, to allow communication of the air G, and therefore, there is no obstacle to the filling of the air G into the long air bags 3L.

Moreover, in the present embodiment, an opening for accommodating the packaged object A is formed in the upper surface of the three-dimensionally formed packaging bag. Thus, the packaged object A is inserted from the opening in the upper surface of the packaging bag, and the opening is enclosed, by turning over inwardly at the bending lines 49, 55, and also by welding the end parts thereof. Moreover, the air unfilled parts 61, 61, positioning at the corner parts on the upper left and right sides, respectively, are folded inwardly to form triangle shapes, so as to form the folded parts 63, 63.

For reference, other than the welding of the opening, it is also possible to adopt the sealing means by using the adhesive tape 47, as described in the first embodiment.

Therefore, also in the present embodiment as described above, substantially the same functions and effects as those of the first embodiment can be expressed, and the packaging and unpackaging of the packaged object A are facilitated, and the storage of the packaging material 1B and the discarding of the packaging bag are simplified.

Moreover, in the present embodiment, it is possible to accommodate a large-sized packaged object A, of which thickness is larger than that applicable to the first embodiment, whereby the applicable type of packaged object A can be broadened.

[Third Embodiment] (See FIG. 11 to FIG. 15)

(1) Overall Structure of a Packaging Material, Details of a Packaging Method, and Packaging and Unpackaging Procedures:

Since the overall structure of the packaging material 1, the details of the packaging method, and the packaging and unpackaging procedures, are substantially the same as those of the first embodiment described above, the detailed explanation thereof will not be made here. Now, the overall structure of a packaging material 1C according to a present embodiment, and the function and effect thereof, which are different from those of the packaging material 1A of the first embodiment, will be chiefly explained.

Figure 14:
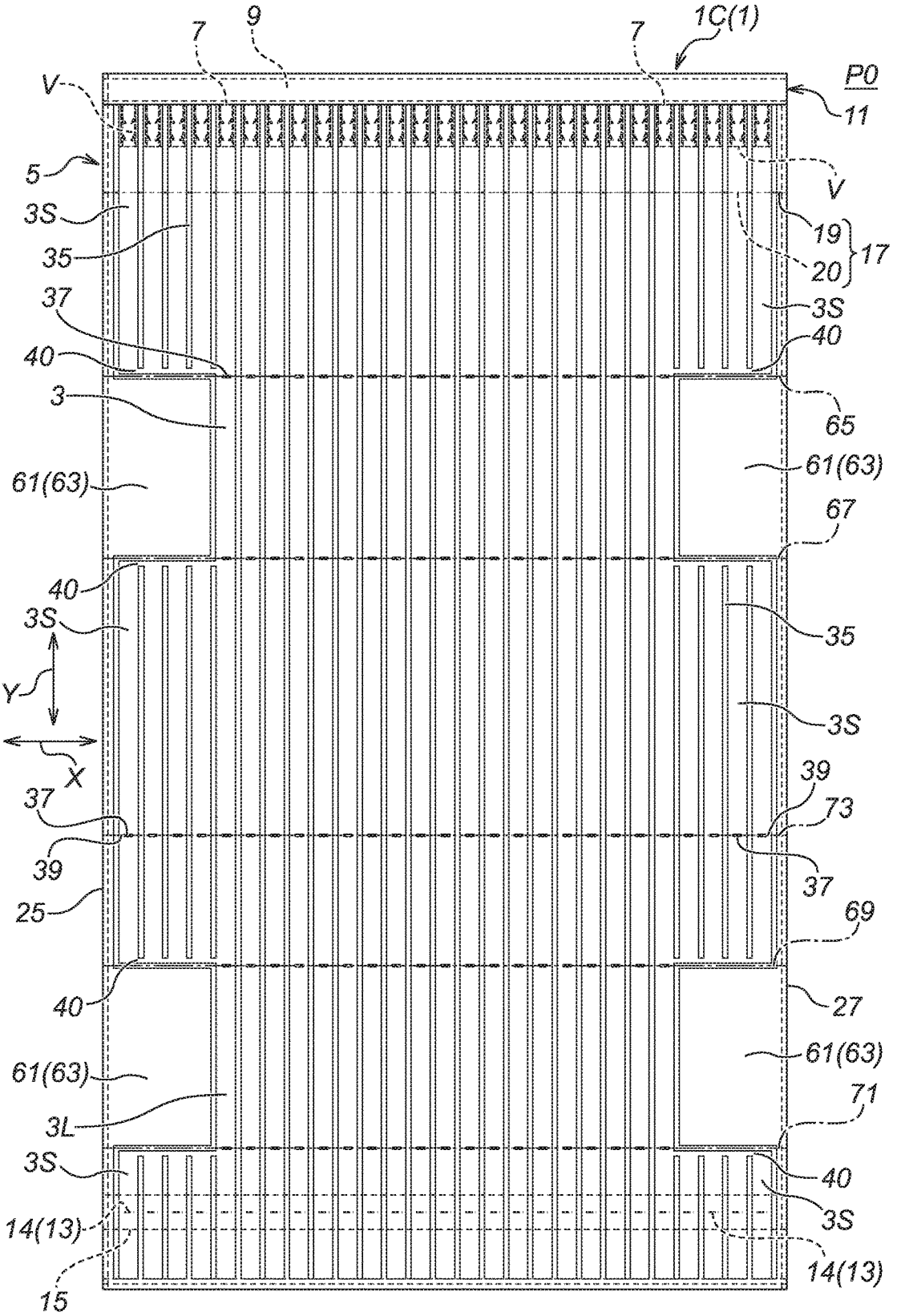
FIG. 14 is a plan view of the packaging material in an expanded state, according to the third embodiment of the present invention.

(2) Specific Structure of the Packaging Material, and the Function and Effect Thereof:

The packaging material 1C is, likewise the case of the packaging material 1A of the first embodiment, a packaging material using a raw material composed of two sheet-shaped raw materials S1, S2 sticking to each other, made of, for example, synthetic resin films, and as illustrated in FIG. 14, is composed of, for example, twenty-seven air bags 3 extending in the lengthwise direction Y, provided consecutively in the widthwise direction X. Among these twenty-seven air bags 3, nineteen long air bags 3L are disposed at the center, and respective four short air bags 3S are provided, on the left and right in the upper, intermediate and lower parts, respectively. Moreover, the air unfilled parts 61, 61, 61, 61 are provided at four positions, respectively, on the left and right, which serve as the folded parts 63, 63, 63, 63 after the three-dimensional forming.

Thus, the packaging material 1C having the above structure is bent along bending lines 65, 67, 69, 71 to form a rectangle shape, and by partially welding the rims of the side edges 25, 27 on the left and right, the three-dimensional forming of a box-shaped packaging bag is performed.

Moreover, when the three-dimensional box-shaped packaging bag is formed, a hinge line 73 is provided, for example, at an intermediate position between the bending lines 67, 69, which serve as a rear surface, and the both end parts of the long air bags 3L, the short air bags 3S are positioned, respectively, at the position on a front surface of the packaging bag, corresponding to the position of the hinge line 73 on the rear surface. This portion serves as an opening when the packaged object A is accommodated.

With this structure, in a state that the opening is not sealed, the upper part above the opening and the hinge line 73 functions as a lid 75, so that the lid 75 may move rotatively around the hinge line 73, in an opening direction and a closing direction of the opening on the front surface.

Moreover, in the present embodiment, the packaging bag is in a state that the corner parts on the left and right of the upper and lower parts (air unfilled parts 61, 61, 61, 61) are somewhat protruding outwardly, and where necessary, these outwardly protruding parts may be depressed inwardly to form the welded parts 63, 63, 63, 63 as per illustrated, so as to form depressed parts 77, 77, 77, 77.

Moreover, likewise the case of the first embodiment, one end part of each of the long air bags 3L, and that of each of the short air bags 3S in the upper part, is provided with the air introduction path 9 extending in the widthwise direction X, and the air introduction port 11 is provided, which is used for introducing the air G into the air introduction path 9, at one end part of the air introduction path 9 in the widthwise direction X.

Figure 15:
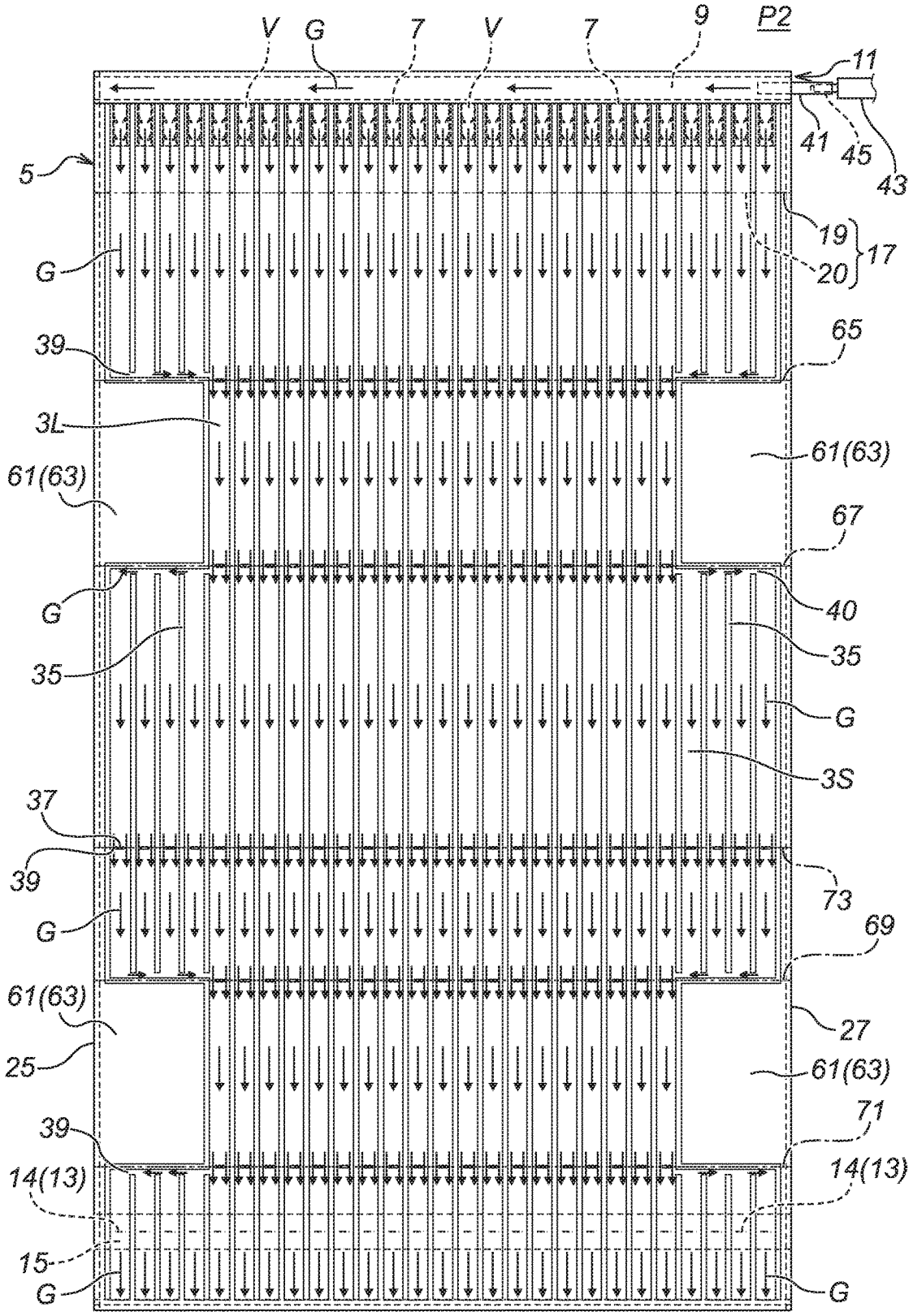
FIG. 15 is a plan view, showing the packaging material in the expanded state, and simultaneously showing the flow of air introduced into each of the air bags, according to the third embodiment of the present invention.

Moreover, another end part of the air introduction path 9 in the widthwise direction X is closed, and the air G introduced from the air introduction port 11 flows, as illustrated in FIG. 15, from the air inlet 7 of the long air bag 3L and that of the short air bag 3S in the upper part, into each of the check valves V, and with the opening of the check valve V, flows into the long air bag 3L, and the short air bag 3S in the upper part, to be filled. The filling of the air into each of the short air bags 3S in the intermediate part and the lower part is performed via the long air bag 3L.

Moreover, the structure of the check valve V is substantially the same as that of the first embodiment described above.

For reference, the air G, once flowed into each of the long air bags 3L and the short air bags 3S, will not flow in the reverse directions because of the function of the check valve V, and remains in the long air bags 3L and the short air bags 3S so as to maintain the filled state.

Moreover, according to the present embodiment, the slits 14 serving as the air discharge openings 13, and the perforations 19 and the line-shaped thin parts 20 serving as the weakened part 17 are provided, for example, on the upper side on the lower side by interposing the opening on the front surface, in the widthwise direction X.

Moreover, likewise the case of the first embodiment as described above, the tape-shaped seal member 15 for concealing the all slits 14 is provided, and by sticking the seal member 15 along the widthwise direction X, the escape of the air G from the slits 14 is prevented.

Moreover, also likewise the case of the first embodiment, the perforations 19 are formed in the welded parts 35, each of which partitions the air bags 3 in the widthwise direction X, and the line-shaped thin parts 20 are formed on the surfaces of the long air bags 3L and the short air bags 3S so as to traverse these air bags.

Moreover, in the present embodiment, the partially welded parts 37 are provided along four bending lines 65, 67, 69, 71, serving as bending parts, respectively, during the three-dimensional forming of the packaging material body 5 so as to form the box-shaped packaging bag, and also along one hinge line 73.

It should be noted that, because of the presence of the partially welded parts 37, the partially welded parts 37 function as the bending lines during bending of the packaging material body 5, and also function as a hinge part during opening and closing of the lid 75, whereby the three-dimensional forming of the packaging material body 5 into the box-shaped packaging box, and the opening and closing of the lid 75, are facilitated.

Meanwhile, the side spaces on the left and right of the partially welded parts 37 serve as the communicating openings 39, 39, to allow communication of the air G. Moreover, communicating openings 40, 40 are provided at the both ends of the welded parts 35 of the short air bags 3S in the intermediate part. Moreover, the communicating opening 40 is also provided at one end of the welded parts 35 of the short air bags 3S in the lower part. Since the air is filled from the side of the long air bags 3L into the side of the short air bags 3S via these communicating openings 40, there is no obstacle to the filling of the air G into the long air bags 3L and the short air bags 3S.

For reference, the communicating openings 40 are also provided on another end of the short air bags 3S in the upper part.

Moreover, in the present embodiment, the opening for accommodating the packaged object A is formed, as an example, on the front surface of the three-dimensionally formed packaging bag. Thus, after opening of the opening and accommodating of the packaged object A in the packaging bag, the opening is closed again, and the opening is sealed thereon, by using the wide adhesive tape 47, etc.

Figure 13:
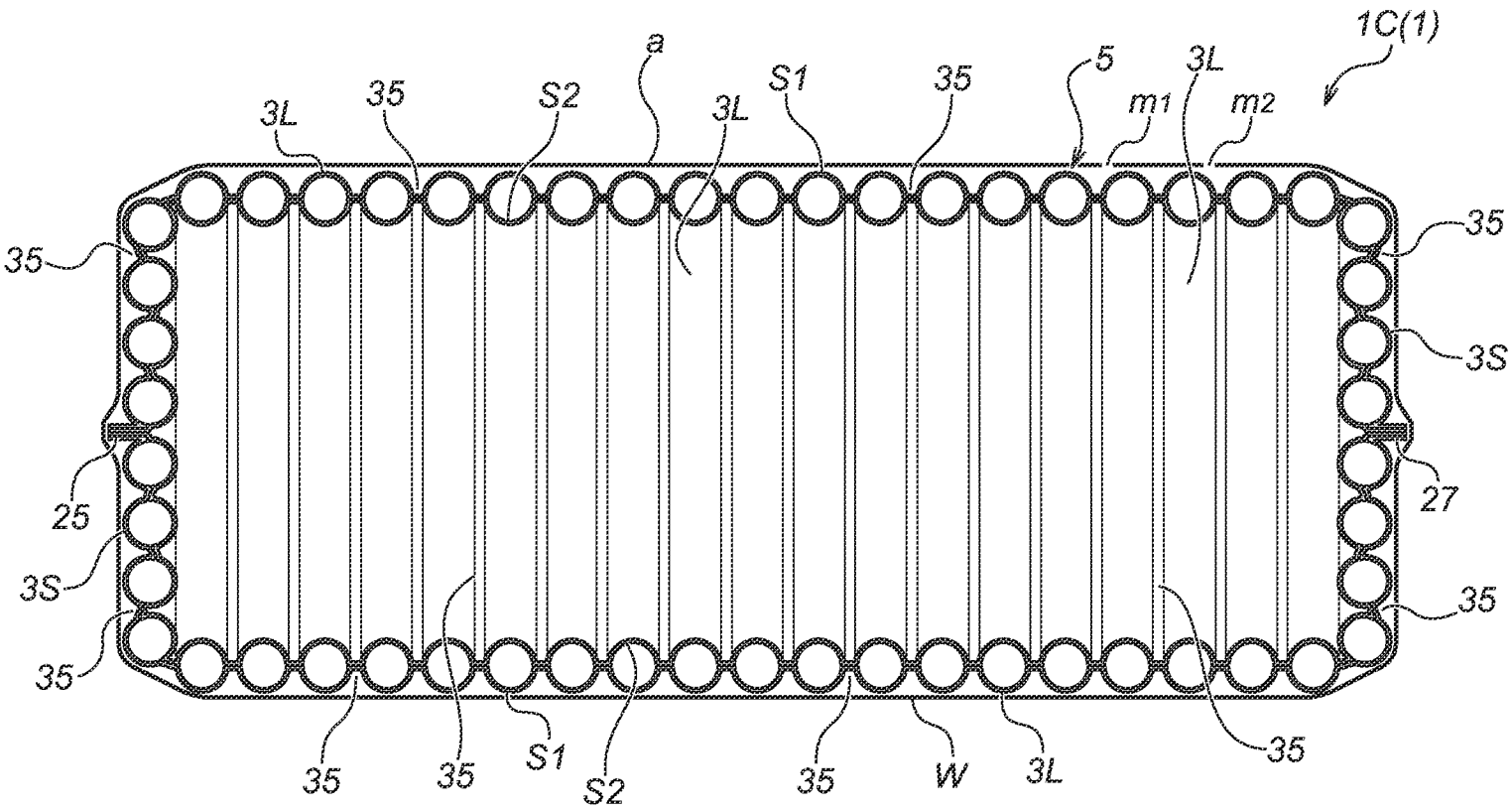
FIG. 13 is a sectional view as seen by the line XIII-XIII of FIG. 12, according to the third embodiment of the present invention.

Moreover, as illustrated in FIG. 13, a black wrap film W, in a tubular shape as a whole, is used for wrapping so as to flatten the surfaces, and an address sticker (not shown) is stuck to an address sticking part a. Moreover, the wrap film W is provided with perforations m1, m2 at intervals, for example, of 30 mm. During unpackaging, the wrap film W is broken via these perforations m1, m2.

For reference, as for the sealing means for sealing the opening on the front surface, it is also possible to adopt other means, such as welding, etc.

Therefore, also in the present embodiment as described above, substantially the same functions and effects as those of the first embodiment can be expressed, and the packaging and unpackaging of the packaged object A are facilitated, and the storage of the packaging material 1C and the discarding of the packaging material 1C are simplified.

Moreover, in the present embodiment, likewise the case of the second embodiment, it is possible to accommodate a large-sized packaged object A, of which thickness is larger than that applicable to the first embodiment, whereby the applicable type of packaged object A can be broadened.

Further, in the present embodiment, the shape of the packaging material body 5 in the expanded state becomes simpler than that of the second embodiment, whereby the efficiency of two-dimensional forming of the packaging material body 5 is improved.

[Fourth Embodiment] (See FIG. 16 to FIG. 19)

(1) Overall Structure of a Packaging Material, Details of a Packaging Method, and Packaging and Unpackaging Procedures:

Since the overall structure of the packaging material 1, the details of the packaging method, and the packaging and unpackaging procedures, are substantially the same as those of the first embodiment described above, the detailed explanation thereof will not be made here. Now, the overall structure of a packaging material 1D according to a present embodiment, and the function and effect thereof, which are different from those of the packaging material 1A of the first embodiment, will be chiefly explained.

Figure 16:
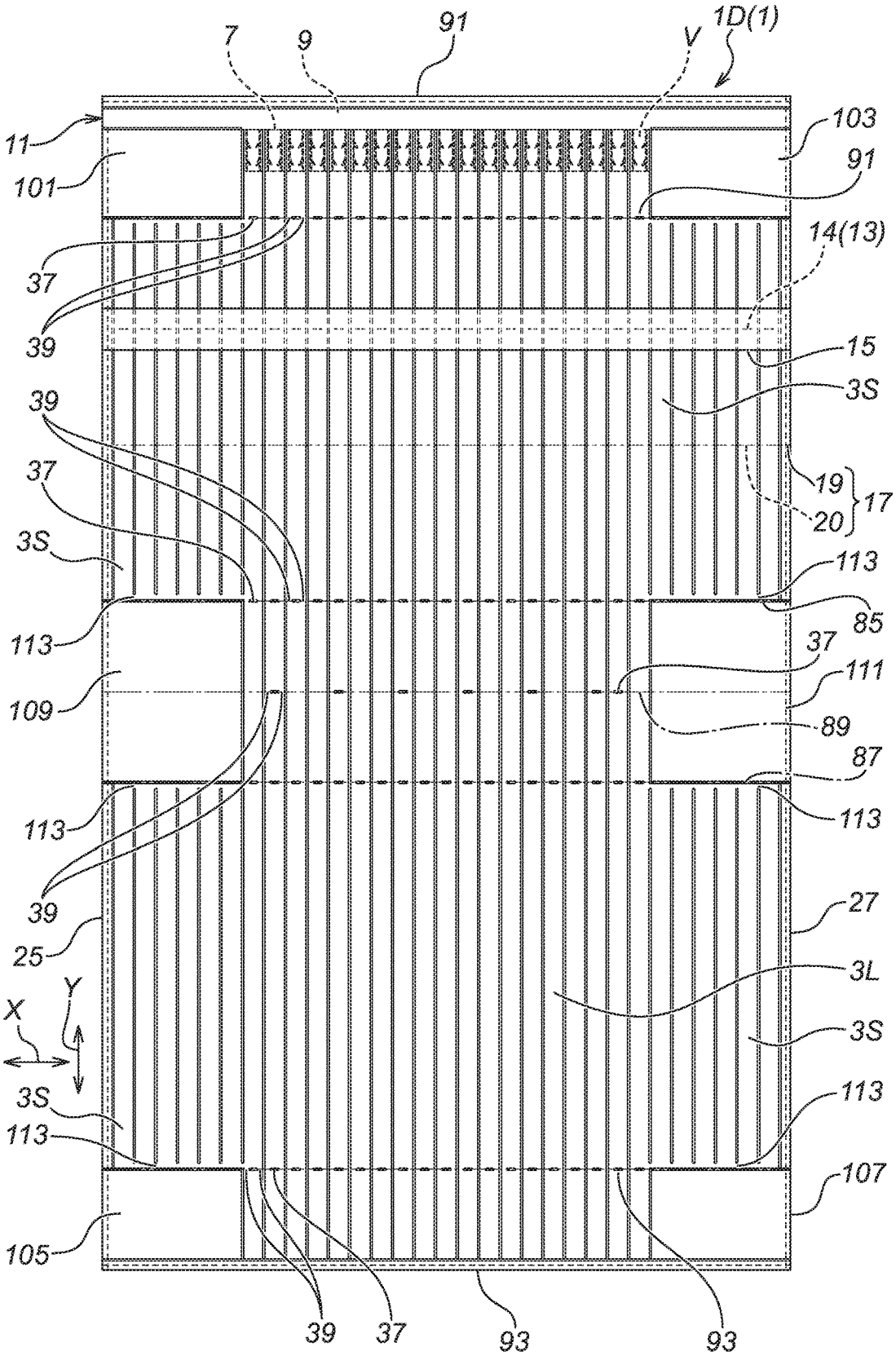
FIG. 16 is a plan view of the packaging material in an expanded state, according to a fourth embodiment of the present invention.
Figure 17A:
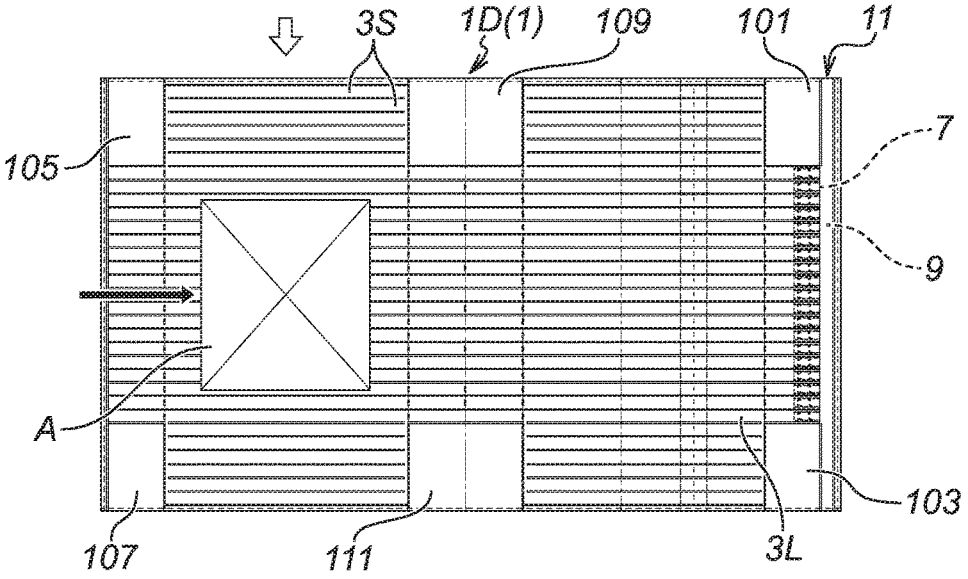
FIG. 17 (*a*) is a plan view showing a state that the packaging material has been expanded, and a packaged object is loaded therein.
Figure 17B:
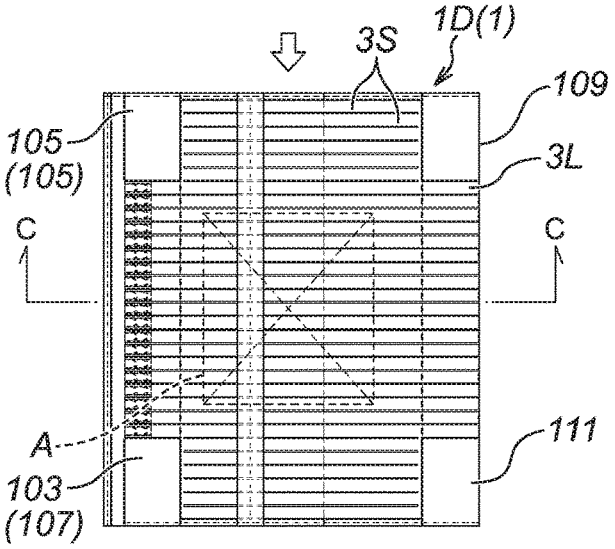
Figure 17C:
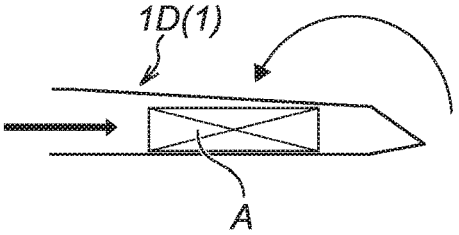
Figure 17D:
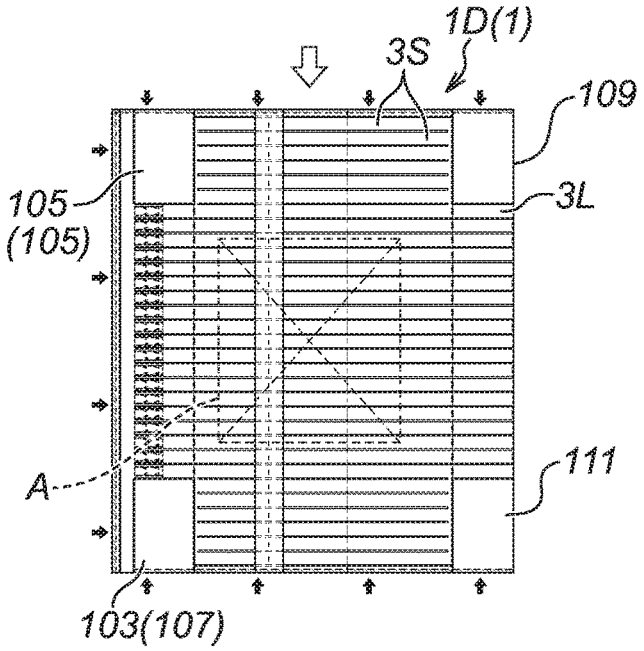
Figure 17E:
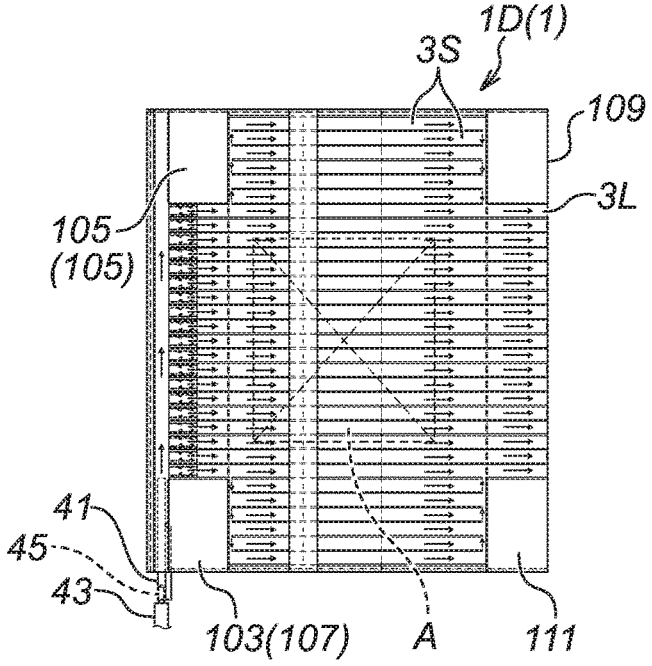

(2) Specific Structure of the Packaging Material, and the Function and Effect Thereof:

The packaging material 1D is, likewise the case of the packaging material 1A of the first embodiment, a packaging material using a raw material composed of two sheet-shaped raw materials S1, S2 sticking to each other, made of, for example, synthetic resin films, and as illustrated in FIG. 16, is composed of, for example, thirty-one air bags 3 extending in the lengthwise direction Y, provided consecutively in the widthwise direction X. Among these air bags 3, nineteen long air bags 3L are disposed at the center, and respective six short air bags 3S are provided, on the left and right in the upper and lower parts, respectively.

Thus, the packaging material 1D having the above structure is bent along bending lines 85, 87, 89, 91, 93 to form a rectangle shape, and by partially welding the rims of the side edges 25, 27 on the left and right, the three-dimensional forming of a box-shaped packaging bag is performed, as illustrated in FIG. 18 and FIG. 19.

For reference, in the case as illustrated in FIG. 18, the three-dimensional forming has been performed so as to form a packaging bag in a thick-shaped box, and in the case as illustrated in FIG. 19, the three-dimensional forming has been performed so as to form a packaging bag in a thick-shaped box.

Moreover, in the present embodiment, as an example, as illustrated in FIG. 17 (*a*), the packaged object A has been loaded into the packaging material 1D in an expanded state, and thereafter, the bending, the welding and sealing thereof are performed. Moreover, as another example, the packaged object A has been loaded into the packaging bag, which was already formed three-dimensionally, and the welding and sealing thereof are performed.

Moreover, as illustrated in FIG. 16, in the present embodiment, air unfilled parts 101, 103, 105, 107, 109, 111 are provided at the corner parts on the left and right of the upper and lower parts, and at the intermediate parts on the left and right, and where necessary, these air unfilled parts 101, 103, 105, 107, 109, 111 are depressed inwardly or welded partially.

For reference, at the time of packaging and delivery, the delivery fee varies depending on the size of the packaged article. Thus, after three-dimensional forming, by pressing the air unfilled parts 101, 103, 105, 107, 111 inwardly, the size as the packaged article can be reduced, thereby cheaper delivery fee may be applied.

Moreover, likewise the case of the first embodiment, one end part of the long air bag 3L is provided with the air introduction path 9 extending in the widthwise direction X, and the air introduction port 11 is provided, which is used for introducing the air G into the air introduction path 9, at one end part of the air introduction path 9 in the widthwise direction X.

Moreover, another end part of the air introduction path 9 in the widthwise direction X is closed, and the air G introduced from the air introduction port 11 flows, as illustrated in FIG. 17 (*e*), from the air inlet 7 of each of the long air bags 3L, into each of the check valves V provided on the air inlet 7, and with the opening of the check valve V, flows into the long air bags 3L to be filled.

Moreover, the structure of the check valve V is substantially the same as that of the first embodiment described above.

For reference, the air G, once flowed into each of the long air bags 3L, will not flow in the reverse directions because of the function of the check valve V, and remains in the long air bags 3L so as to maintain the filled state.

Moreover, according to the present embodiment, the slits 14 serving as the air discharge openings 13, and the perforations 19 and the line-shaped thin parts 20 serving as the weakened part 17 are provided in the widthwise direction X.

Moreover, likewise the case of the first embodiment as described above, the tape-shaped seal member 15 for concealing the all slits 14 is provided, and by sticking the seal member 15 along the widthwise direction X, the escape of the air G from the slits 14 is prevented.

For reference, as illustrated in FIG. 18 and FIG. 19, at the end of the seal member 15 sticking to the welded side edge 27, a V-shaped cutout 27*v* as a cutout part is provided. By tearing via the V-shaped cutout 27*v*, it is also possible to open the packaging material body 5.

For reference, with regard to a position at the V-shaped cutout 27*v* is provided, for example, in the case as illustrated in FIG. 19, it is also possible to provide at the air unfilled parts 101 (105), 103 (107), whereby further facilitated unpackaging can be accomplished.

Moreover, also likewise the case of the first embodiment, the perforations 19 are formed in the welded parts 35, each of which partitions the air bags 3 in the widthwise direction X, and the line-shaped thin parts 20 are formed on the surfaces of the air bags 3 so as to traverse these air bags.

Moreover, in the present embodiment, the partially welded parts 37 are provided along five bending lines 85, 87, 89, 91, 93, serving as bending parts, respectively, during the three-dimensional forming of the packaging material body 5 so as to form the box-shaped packaging bag.

It should be noted that, because of the presence of the partially welded parts 37, the partially welded parts 37 function as the bending lines during bending of the packaging material body 5.

Meanwhile, the side spaces on the left and right of the partially welded parts 37 serve as the communicating openings 39, 39, to allow communication of the air G, and therefore, there is no obstacle to the filling of the air G into the long air bags 3L and the short air bags 3S.

Moreover, in the present embodiment, communicating openings 113, 113 are provided at the both ends of the welded parts 35 of each of the short air bags 3S at protruding parts on the left and right of FIG. 16. With these communicating openings 113, the air from the adjacent long air bags 3L is also filled into the short air bags 3S in the protruding parts.

Next, the procedural order of packaging of the packaged object A is explained with reference to FIG. 17.

First, as illustrated in FIG. 17 (*a*), the packaging material 1D is supplied in an expanded state.

For reference, although a packaging material 1D at a predetermined width in the direction of an arrow is shown in FIG. 17 (*a*), practically, the supply is performed continuously.

In this state, the packaged object A is loaded onto the packaging material 1D.

Next, as illustrated FIG. 17 (*b*) and (*c*), the packaging material 1D is folded into two parts.

Next, as illustrated in FIG. 17 (*d*), the openings on three sides are welded. Thus, the packaged object A is accommodated therein and becomes in a sealed state.

Next, as illustrated in FIG. 17 (*e*), the straw-shaped air injection pipe 41*a* is inserted into the air introduction port 11, and for example, the nozzle 45 of the air gun 43 is inserted into the air injection pipe 41, so as to fill the air. Thus, via each of the check valves V, the air is filled into the plurality of long air bags 3L, and further into the short air bags 3S.

For reference, in FIG. 17 (*e*), the nozzle is fixed, and meanwhile, the packaging material 1D is transferred from the upper part to the lower part of the drawings, and at that time, the left end of the packaging material 1D is cut by a cutter (not shown) attached to the nozzle 45.

Thereafter, the cutting is performed at the welded part of the upper part of FIG. 17 (*e*) as a boundary, whereby the packaged article accommodating the packaged object A is obtained.

As a result, the packaged article as illustrated in FIG. 18 is obtained. As illustrated in FIG. 18, the air unfilled parts 101, 103, 105, 107, 109, 111 at four corners are depressed inwardly. Moreover, FIG. 18 shows the case in which the packaged object A is thick.

On the other hand, FIG. 19 shows a state where the accommodated packaged object A is thin. In this case, the air unfilled parts 101, 103, 105, 107, 109, 111 are protruding outwardly, and welded partially. Namely, heat bonding has been performed partially, to the air unfilled parts 101 and 105, 103 and 107, 109 each, 111 each, respectively configured to oppose to each other, so as to be depressed to be flattened corresponding to the thickness of the packaged object A. The welded parts are shown by reference sign 121 in the drawing (the parts shown by imaginary lines).

For reference, in FIG. 19, although the welded part is in a shape of the letter "L," but it is also possible to provide the welded part in a round shape, and also the welded part in other various shapes.

Moreover, the positions of the welded parts 121 vary depending on the thickness of the packaged object A. For example, where the packaged object A is thin, the welding is performed at the part close to the root, and the thicker the packaged object A becomes, the further the welding position shifts outwardly in the radial direction. Accordingly, in the thickest case, the heat bonding is not performed, and becomes in the state as illustrated in FIG. 18.

For reference, even in the case of thin object as illustrated in FIG. 19, there may be a case that the air unfilled parts 101 and 105, 103 and 107, 109 each, 111 each, are not welded to each other.

For reference, as for the packaging method, where a certain degree of automation is assumed, the process is that as illustrated in FIG. 17. However, where a manual work is assumed, the following procedure is performed.

First, the case, in which a relatively thin packaged object A is packaged, will be explained.

The packaging bag has been prepared in advance, by folding the packaging material 1D as illustrated in FIG. 16 into the upper and lower two parts, and by welding the side edges 25, 27 on the left and right. The packaging bag in such a structure is provided at a site where the packaging work is performed. At that time, the air unfilled parts 101 and 105, 103 and 107, 109 each, 111 each, have been welded to each other.

Next, a worker loads the packaged object A into the packaging bag.

Next, the packaging bag is depressed by hands so as to discharge the air from the inside, and the opening is welded to be enclosed.

Next, for example, the air gun 43 as illustrated in FIG. 5 is used to fill the air into the long air bags 3L and the short air bags 3S. Thus the packaged article as illustrated in FIG. 19 is obtained.

Next, the case, in which a relatively thick packaged object A is packaged, will be explained.

The packaging bag has been prepared in advance, by folding the packaging material 1D as illustrated in FIG. 16 into the upper and lower two parts, and by welding the side edges 25, 27 on the left and right. The packaging bag in such a structure is provided at a site where the packaging work is performed. At that time, the air unfilled parts 101 and 105, 103 and 107, 109 each, 111 each, are not specifically welded to each other.

Next, a worker loads the packaged object A into the packaging bag.

Next, the air is deflated from the inside, by using a suction device provided separately, and the opening is welded to be enclosed.

Next, the air unfilled parts 101 and 105, 103 and 107, 109 each, 111 each, are depressed inwardly.

Next, for example, the air gun 43 as illustrated in FIG. 5 is used to fill the air into the long air bags 3L and the short air bags 3S. Thus the packaged article as illustrated in FIG. 18 is obtained.

For reference, although this is true to the both thick and thin packaged objects A, when the packaging bag is prepared, after folding into the two parts, it is arbitrary which one of the sides should be designated as the opening for the loading of the packaged object A, and as already explained, other than to designate the side provided with the check valve V as the opening for loading of the packaged object A, it is also possible to designate the side of the edge side 25 or the edge side 27 as the opening for the loading. Where the check valve V is provided, when folded into the two parts, an accurate positioning of each end part at a predetermined position must be performed, so as not to deteriorate the function of the check valve V. Therefore, at the time of preparation of the packaging bag, the side where the check valve V has been formed is welded, and also, by welding either side of the side edge 25 or the side edge 27, the rest side of the side edge 25 and the side edge 27 may be used as the opening for the loading.

Therefore, also in the fourth embodiment as described above, substantially the same functions and effects as those of the first embodiment can be expressed, and the packaging and unpackaging of the packaged object A are facilitated, and the storage of the packaging material body 5 and the discarding of the packaging material 1D are simplified.

[Fifth Embodiment] (See FIG. 20)

For example, where a vacant space is generated between the packaging bag and the packaged object A, for the purpose of filling the vacant space, for example, it is possible to use a buffer material 79 simultaneously, as illustrated in FIG. 20. The buffer material 79 is provided with an air bag 81, and the check valve V is attached to the air bag 81. The check valve V has substantially the same structure as that used in the first to the fourth embodiments, composed of the front wall v1, the rear wall v2, and the primary valve flap part v3 and the secondary valve flap part v4, respectively comprising the pair of heat seal parts on the left and right. The front wall v1 is shorter than the rear wall v2, and an air introduction port 85 is provided therebetween. By using the buffer material 79 in the above structure, it is possible to fill the vacant space.

For reference, it is also possible to stick this type of buffer material 79 to an appropriate position of the packaging material 1 in advance.

[Sixth Embodiment] (See FIG. 21 to FIG. 24)

(1) Overall Structure of a Packaging Material, Details of a Packaging Method, and Packaging and Unpackaging Procedures:

Since the overall structure of the packaging material 1, the details of the packaging method, and the packaging and unpackaging procedures, are substantially the same as those of the first embodiment described above, the detailed explanation thereof will not be made here. Now, the overall structure of a packaging material 1E according to a present embodiment, and the function and effect thereof, which are different from those of the packaging material 1A of the first embodiment, will be chiefly explained.

For reference, the packaging material 1E according to the sixth embodiment has substantially the same structure as the packaging material 1D of the fourth embodiment described above, certain shapes are different from each other.

Figure 21:
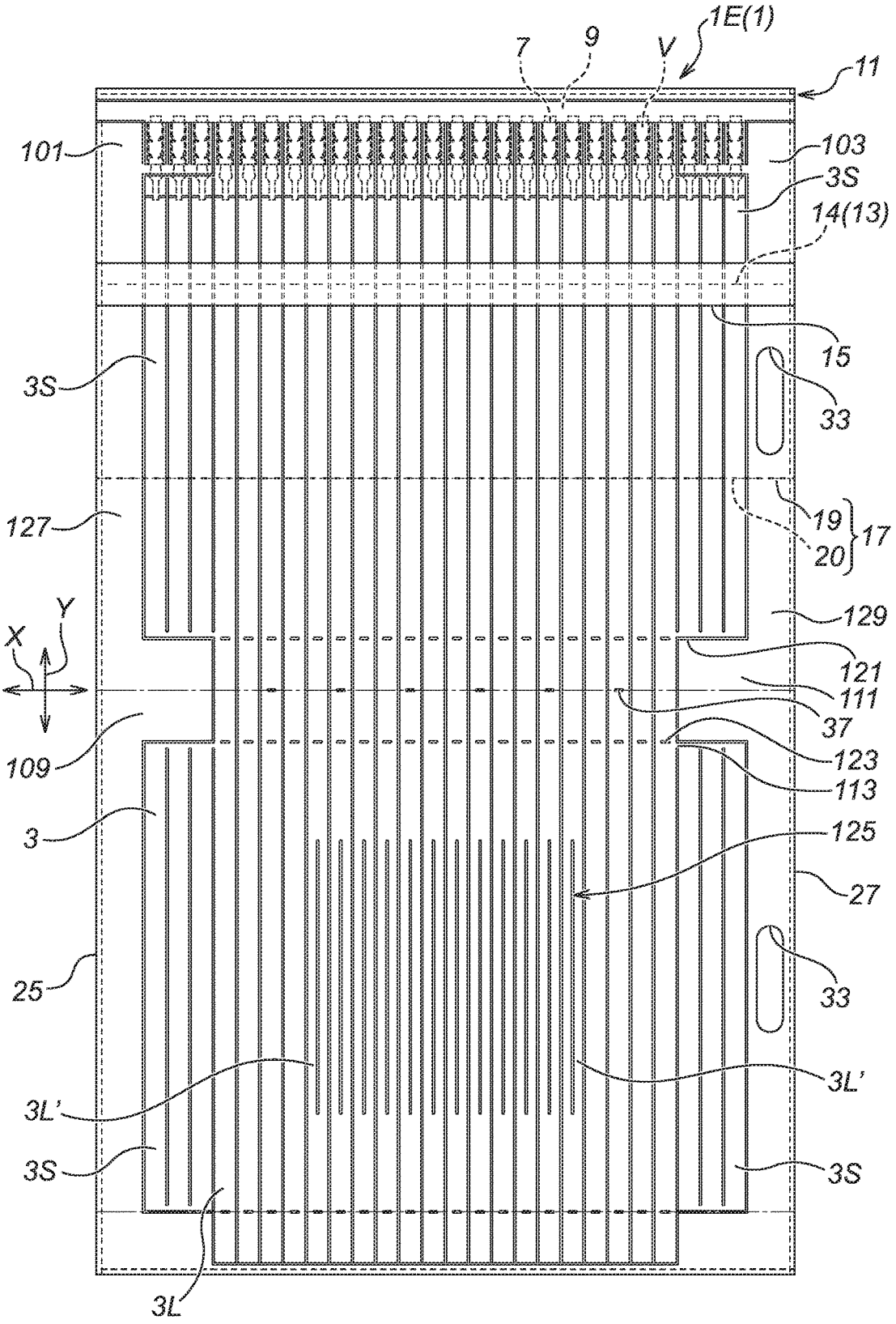
FIG. 21 is a plan view of a packaging material in an expanded state, according to a sixth embodiment of the present invention.

(2) Specific Structure of the Packaging Material, and the Function and Effect Thereof:

The packaging material 1E is, likewise the case of the packaging material 1A of the first embodiment, a packaging material using a raw material composed of two sheet-shaped raw materials S1, S2 sticking to each other, made of, for example, synthetic resin films, and as illustrated in FIG. 21, is composed of, for example, twenty-six air bags 3 extending in the lengthwise direction Y, provided consecutively in the widthwise direction X. Among these air bags 3, twenty air bags at the center are the long air bags 3L, and respective three short air bags 3S are provided, on the left and right in the upper and lower parts, respectively.

Moreover, rectangle-shaped sheet pieces 127, 129 are provided on the left and right of FIG. 21, and in the upper, lower and intermediate parts thereof on the left and right, the air unfilled parts 101, 103, 105, 107, 109, 111 are provided.

The packaging material 1E having the above structure is bent along bending lines 121, 123 to form a rectangle shape, and by welding the rims of the side edges 25, 27 on the left and right, the three-dimensional forming of a box-shaped packaging bag is performed.

Moreover, a sheet sticking part 125 is provided, and air bags 3L', of which respective diameter is the half that of the long air bag 3L, are provided at the sheet sticking part 125.

With these thin-shaped air bags 3L', the sheet sticking part 125 may become closer to a flat surface, whereby the sheet, for example an invoice, can be stuck thereto easily.

For reference, in the present embodiment, as an example, the structure in which the sheet sticking part 125 is provided on one side of the packaging bag is explained. However, it is also possible to provide a similar area on the other side of the packaging bag, so that, for example, a sheet indicating the information related to the packaged object A can be attached thereto.

Moreover, the sheet piece 129 has the Holes 33, 33 formed therein, which, by sticking to each other, serve as the carrying handle. Moreover, in the present embodiment, as an example, the packaged object A is placed on the packaging material 1E in the expanded state, and thereafter, bending, welding and sealing are performed. Moreover, as another example, the packaging bag is prepared by bending, and also by welding two sides, and the packaged object A is loaded into this packaging bag, and the rest opening is welded and sealed.

Moreover, the air unfilled parts 101 and 105, 103 and 107, 109 each, 111 each, are coupled with each other, respectively, during the three-dimensional forming, and where necessary, are welded partially or depressed inwardly.

Moreover, likewise the case of the first embodiment, one end part of each of the air bags 3 is provided with the air introduction path 9 extending in the widthwise direction X, and the air introduction port 11 is provided, which is used for introducing the air G into the air introduction path 9, at one end part of the air introduction path 9 in the widthwise direction X. Moreover, another end part of the air introduction path 9 in the widthwise direction X is closed, and the air G introduced from the air introduction port 11 flows, from the air inlet 7 of each of the air bags 3, into each of the check valves V provided on the air inlet 7, and with the opening of the check valve V, flows into each of the air bags 3L, 3L' to be filled.

Moreover, the structure of the check valve V is substantially the same as that of the first embodiment described above. Moreover, in the present embodiment, in FIG. 21, each three check valves V on the left and right are closed by welding. Thus, the air is filled into each three short air bags 3S on the left and right from the side of the long air bags 3L, via the communicating openings 113.

For reference, the air G, once flowed into each of the air bags 3, will not flow in the reverse directions because of the function of the check valve V, and remains in the air bags 3 so as to maintain the filled state.

Moreover, according to the present embodiment, the slits 14 serving as the air discharge openings 13, and the perforations 19 and the line-shaped thin parts 20 serving as the weakened part 17 are provided, as an example, in the widthwise direction X.

Moreover, likewise the case of the first embodiment as described above, the tape-shaped seal member 15 for concealing the all slits 14 is provided, and by sticking the seal member 15 along the widthwise direction X, the escape of the air G from the slits 14 is prevented.

Moreover, also likewise the case of the first embodiment, the perforations 19 are formed in the welded parts 35, each of which partitions the air bags 3 in the widthwise direction X, and the line-shaped thin parts 20 are formed on the surfaces of the air bags 3 so as to traverse these air bags.

Moreover, in the present embodiment, the partially welded parts 37 are provided along the bending lines 121, 123 serving as bending parts, respectively, during the three-dimensional forming of the packaging material body 5 so as to form the box-shaped packaging bag. Because of the presence of the partially welded parts 37, the partially welded parts 37 function as the bending lines during bending of the packaging material body 5. Meanwhile, the side spaces on the left and right of the partially welded parts 37 serve as the communicating openings 39, 39, to allow communication of the air G, and therefore, there is no obstacle to the filling of the air G into the air bags 3.

Moreover, in the present embodiment, the communicating openings 113, 113 are provided at the both ends of the welded parts 35 of each of the short air bags 3S at protruding parts on the left and right of FIG. 21. With these communicating openings 113, the air from the adjacent long air bags 3L is also filled into the short air bags 3S in the protruding parts.

For reference, the communicating openings 113 are also provided at the lower end of the welded parts 35 of the short air bags 3S protruding to the left and right in the upper part of FIG. 21.

Figure 22:
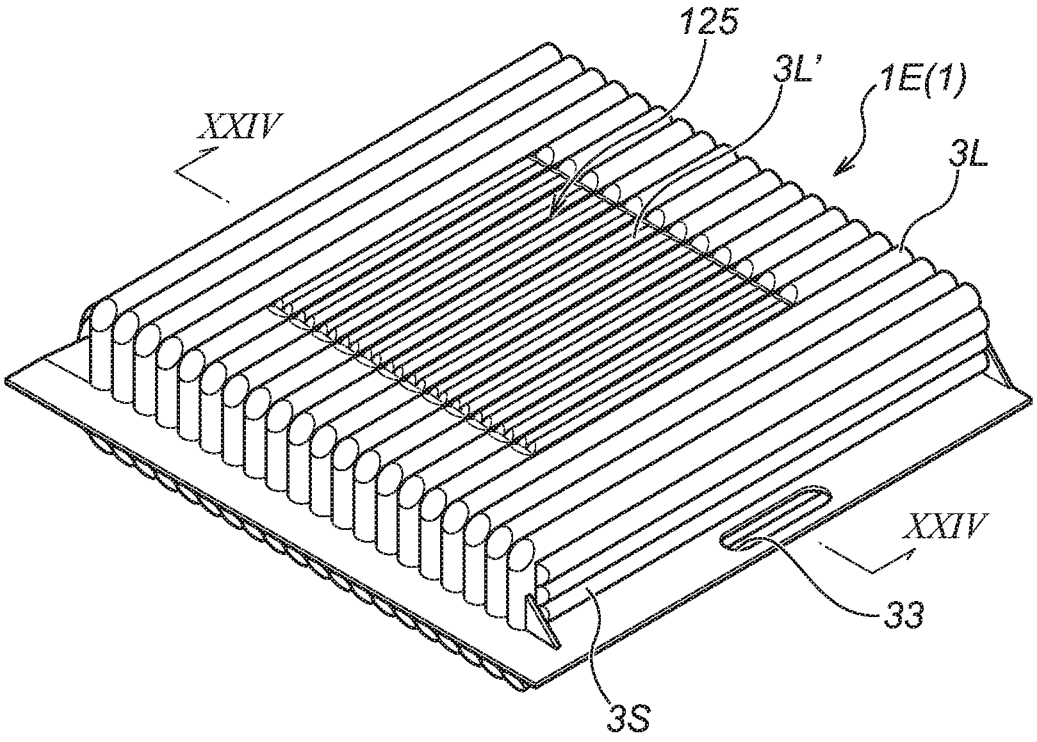
FIG. 22 is a perspective view of the packaging bag formed in a three-dimensional shape by using the packaging material, according to the sixth embodiment of the present invention.
Figure 23:
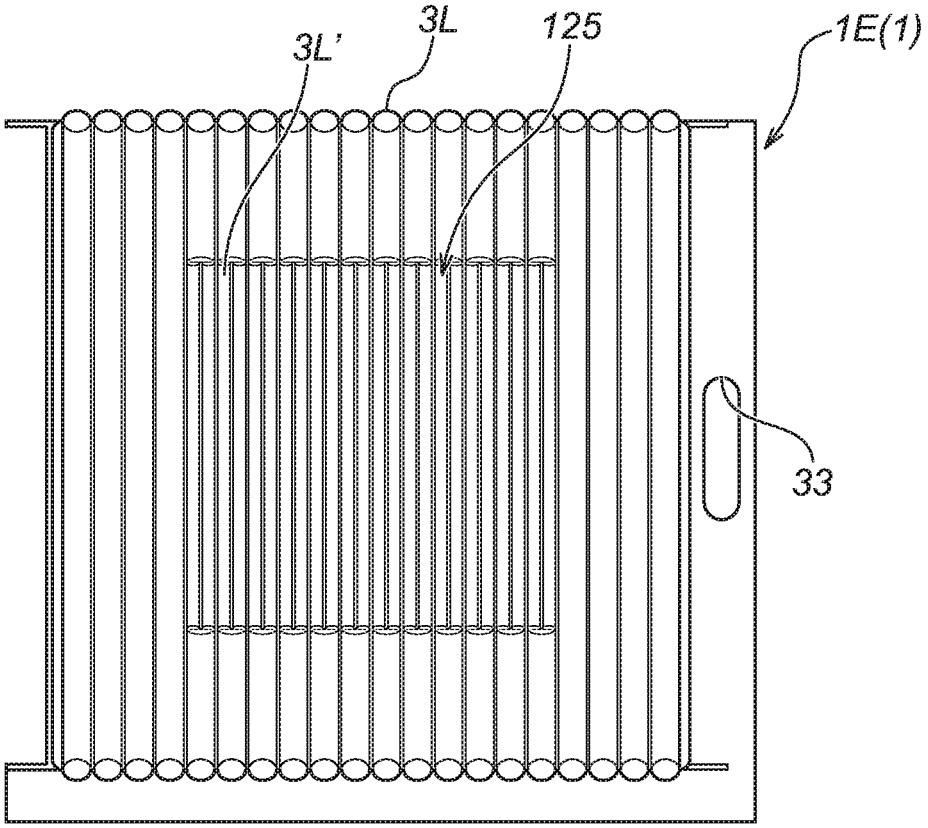
FIG. 23 is a front view of the packaging bag formed in the three-dimensional shape by using the packaging material, according to the sixth embodiment of the present invention.
Figure 24:
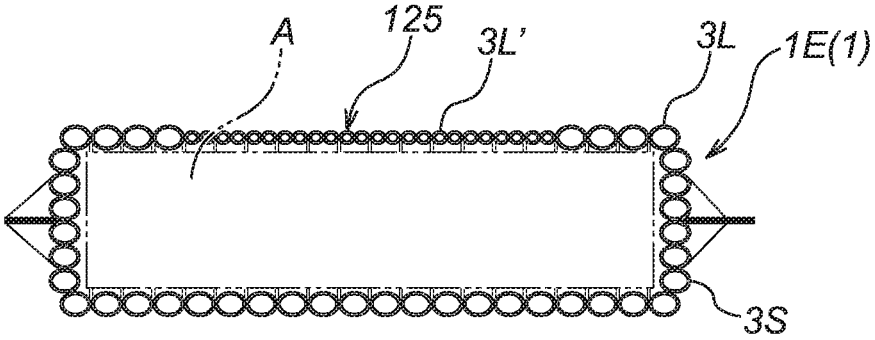
FIG. 24 is a sectional view as seen by the line XXIV-XXIV of FIG. 22, according to the sixth embodiment of the present invention.

The three-dimensionally formed packaging bag, and the packaged article accommodating the packaged object A, are illustrated in FIG. 22 to FIG. 24.

Therefore, also in the sixth embodiment as described above, substantially the same functions and effects as those of the first embodiment can be expressed, and the packaging and unpackaging of the packaged object A are facilitated, and the storage of the packaging material body 5 and the discarding of the packaging material 1E are simplified.

Other Embodiments

The present invention is not limited to the first to the six embodiments as described above.

For example, the number and the size (the opening area and the length) of the air bags 3 are not limited to those as explained in the first to the sixth embodiments, and it is possible to set appropriately, corresponding to the type and shape, or the size and number of the packaged objects A.

Moreover, in the first to the sixth embodiments, one air introduction path 9 and one air introduction port 11, respectively, are provided, but it is not limited to this structure, and it is also possible to provide in a plural number, such as to provide one each, at the both ends of the air bag 3.

Moreover, the air discharge opening 13 is not limited to the slit 14, and fine holes may also be used. The weakened part 17 is also not limited to the perforation 19 and the line-shaped thin part 20, and it is also possible to adopt other structures, such as to configure thin parts in a dotted-line pattern, or to combine with any other easily breakable raw material, etc.

Moreover, in the first to the sixth embodiment, the explanations have been made by exemplifying the case of combination of the air discharge opening 13 with the weakened part 17, and the case of further providing of the V-shaped cutout, etc. However, it is also possible to adopt other various structures, such as that in which, only the air discharge opening 13 is provided, only the weakened part 17 is provided, or simply the V-shaped cutout is provided, etc.

Moreover, it is also possible to provide a structure, in which, merely a cutting line is drawn by printing, etc.

Further, where the air G may be filled into the air bags 3 simultaneously with the two-dimensional forming of the packaging material body 5, it is also possible to omit the check valve V, the air introduction path 9 and the air introduction port 11, which have been provided in each of the above embodiments.

Moreover, where the two-dimensionally formed packaging material body 5 is supplied to the packaging site as a raw material, the two-dimensional forming process P0 of the packaging material, which is adopted in the first embodiment described above, may be omitted, so that the packaging method of the present invention can be composed of the three-dimensional forming process P1, the air filling process P2, the loading process P3 and the sealing process P4 only.

Further, the structures illustrated in the drawings are for the example purposes only.

INDUSTRIAL APPLICABILITY

The present invention relates to a packaging material, packaging bag, packaging article and packaging method, used for accommodating a packaged object, and in particular, the present invention relates to those which, by adding a buffer function to the packaging material itself, facilitate complicated packaging and unpackaging of the packaged object, and also simplify discarding after using thereof, and the present invention is suitable for packaging, for example, foods and beverages such as eggs, tofu, vegetables, fruits or milk, or daily commodities such as garment or furniture, or fragile articles, such as electronic parts, precision instruments or semiconductors.

EXPLANATION OF REFERENCE NUMERALS AND SIGNS

1 Packaging Material
3 Air Bag
5 Packaging Material Body
7 Air Inlet
9 Air Introduction Path
11 Air Introduction Port
13 Air Discharge Opening
14 Slit
15 Seal Member
17 Weakened Part
19 Perforation
20 (Line-shaped) thin part
21 Bending Line (Bending Part)
23 Bending Line (Bending Part)
25 Side Edge
27 Side Edge
29 Sheet Piece
31 Sheet Piece
33 Hole Part
35 Welded Part
37 Partially Welded Part
39 Communicating Opening
41 Air Injection Pipe
43 Air Gun
45 Nozzle
47 Adhesive Tape
49 Bending Line
51 Bending Line
53 Bending Line
55 Bending Line
57 End Side Edge
59 End Side Edge
61 Air Unfilled Part
63 Folded Part
65 Bending Line
67 Bending Line
69 Bending Line
71 Bending Line
73 Hinge Line
75 Lid
77 Depressed Part
79 Buffer Material
81 Air Bag
83 Air Introduction Path
85 Air Introduction Port
87 Air Inlet
P0 Packaging Material Body Two-Dimensional Forming Process
P1 Packaging Material Body Three-Dimensional Forming Process
P2 Air Filling Process
P4 Sealing Process
A Packaged Object
V Check Valve
V2 Bidirectional Check Valve
Y Lengthwise Direction
X Widthwise Direction
G Air
S Sheet-shaped Raw Material
T (Reinforcing) Sheet-shaped Raw Material

The invention claimed is:

1. A packaging material provided comprising:

a packaging material body, formed into a rectangle sheet shape as a whole, by welding two film sheets consisting of an upper sheet and a lower sheet together at points;

an air introduction path, provided on one side edge of the packaging material body, and having one side thereof serving as an air introduction port and also having the other side sealed;

a plurality of long air bags, provided in the packaging material body in communication with the air introduction path, and extending in a direction orthogonal to the air introduction path; and check valves, provided in respective air inlets of the plurality of long air bags, and preventing escaping of air, having been introduced through the air introduction port and introduced into the long air bags through the air inlets;

short air bags, provided on left and right of the long air bags, communicating therewith via an upper communicating part and a lower communicating part, and air, having been introduced into the long air bag via the check valve, being introduced into the short air bags via the communicating parts;

the long air bags and the short air bags, being arranged in a shape so that the long air bags are disposed parallel to each other at a center and the short air bags are disposed parallel to each other on the left and right in upper and lower parts of the long air bags;

air unfilled parts, provided at four corners of the packaging material body and at a space between each of the short air bags, on the left and right of the long air bag without having the short air bag; and partially welded parts provided in the long air bags so that a boundary between the short air bags and the air unfilled parts is connected to the left and right across the long air bags, and function as bending lines;

wherein the packaging material body is wholly folded into two parts from a side of the one side edge toward a side of another side edge, so as to provide a packaging bag for storing a packaged object.

2. The packaging bag as claimed in claim 1, wherein the packaging material is wholly folded into two parts from the side of the one side edge toward the side of the another side edge, and wherein each side has a rim, wherein two rims of three overlapping rims are welded to define, an opening.

3. The packaging bag as claimed in claim 2, wherein one of the welded rims is the side provided with the check valve.

4. The packaging bag as claimed in claim 2, wherein:

overlapping air unfilled parts are welded to each other at positions corresponding to thickness of a packaged object.

5. A packaging method wherein:

a packaged object is placed on the packaging material as claimed in claim 1;

as a next step, the packaging material is wholly folded into two parts from the side of the one side edge toward the side of the other side edge, and rims of three sides of three overlapping rims are welded to be enclosed; and as a next step, each of the air bags is inflated by introducing air into the air introduction path.

6. A packaging method wherein:

a packaged object is loaded into the packaging bag as claimed in claim 2;

as a next step, the opening on the rest one side of the packaging bag is welded to be enclosed; and as a next step, each of the air bags is inflated by introducing air into the air introduction path.

7. The packaging method as claimed in claim 5, wherein:

during welding of the packaging bag to be enclosed, air in the inside of the packaging bag is discharged.

* * * * *